United States Patent [19]

Boccon-Gibod

[11] 4,053,010

[45] Oct. 11, 1977

[54] PROCESS AND APPARATUS FOR THE CONTINUOUS CASTING OF METAL PRODUCTS

[75] Inventor: Raymond Boccon-Gibod, Paris, France

[73] Assignee: Societe de vente de l'Aluminium Pechiney, Paris, France

[21] Appl. No.: 698,183

[22] Filed: June 21, 1976

[30] Foreign Application Priority Data

July 8, 1975 France ..... 75.22021
July 23, 1975 France ..... 75.24452

[51] Int. Cl.[2] ..... B22D 11/06

[52] U.S. Cl. ..... 164/86; 164/87; 164/259; 164/431; 164/437; 164/443

[58] Field of Search ..... 164/86, 87, 276, 278, 164/279, 281, 283 MT, 324, 325, 329, 277, 259

[56] References Cited

U.S. PATENT DOCUMENTS

| | | | |
|---|---|---|---|
| 359,348 | 3/1887 | Daniels | 164/279 X |
| 2,931,082 | 4/1960 | Brennan | 164/86 X |
| 3,416,594 | 12/1968 | Gyongyos | 164/278 |
| 3,605,868 | 9/1971 | Giadorou | 164/279 |
| 3,746,071 | 7/1973 | Schey | 164/277 X |

FOREIGN PATENT DOCUMENTS

| | | | |
|---|---|---|---|
| 992,759 | 10/1951 | France | 164/279 |

*Primary Examiner*—Ronald J. Shore
*Attorney, Agent, or Firm*—Dennison, Dennison, Meserole & Pollack

[57] ABSTRACT

Process and apparatus for casting liquid metal in an ingot mold consisting of opposed cooled casting surfaces, at least one of which is convex, and one of which consists of a series of joined shutters. A high pressure is applied to the metal moving between the two surfaces during the solidification of the metal.

25 Claims, 28 Drawing Figures

PROCESS AND APPARATUS FOR THE CONTINUOUS CASTING OF METAL PRODUCTS

The invention concerns a process and apparatus for the continuous casting of metal alloys, and in particular alloys, in a manner which enables the selective casting of thin strip products, ingots, small or large diameter bars and other products described herinafter with the only additional equipment cost being that of altering the dimensional parameters of the machines.

Continuous vertical or horizontal casting of semi-finished products such as slabs, plates, and billets has been accepted for a long time as a necessary intermediate stage in obtaining finished products of quality. Thus, in order to obtain aluminium alloy sheets of a few millimeters or fractions or millimeters for example, the following procedure is generally adopted:

1. Liquid metal is cast by continuous casting in the form of parallelepiped slabs whose dimensions may be large, for example 3 m long, 2 m wide and 0.5 m thick.

2. These slabs are then rolled hot to a thickness of the order of a few millimeters. This hot rolling operation is very often first of all carried out in a reversing rolling mill, and then in a system comprising several rolling mill stands in succession, the so-called tandem train.

3. The transformation is then completed by cold rolling to give the final thickness.

In order to obtain 9.5 mm rods of aluminium alloy, the following parallel method of operation has been carried out for many years:

1. The liquid metal is cast by continuous casting in the form of billets of circular cross-section, of diameter 200 or 300 mm for example.

2. These billets are then hot extruded in a multi-discharge extrusion press to obtain wires of the desired diameter.

Those working in this field have for a long time attempted to find more direct and economical transformation processes.

In the manufacture of sheets attempts have been made to avoid the heaviest operation as regards investment, namely the hot rolling operation. Modern hot rolling mill trains are in fact very large and very costly pieces of equipment whose investment costs are reflected unfavorably in the cost price of sheets manufactured by using these rolling mills. Attempts therefore have been made to avoid this transformation stage by trying to cast directly thin products having a thickness close to that of products coming from hot rolling mills. These products may then be subjected to cold rolling immediately at the outlet of the casting system.

Such direct casting processes for thin strips are fairly numerous and are based on various principles including casting between bands or strips wherein the liquid metal is cast between two continuous metal strips, most often of steel, turning in opposite directions and carried by a system which is sometimes augmented by support drums and wheels. These strips are cooled internally. Such a system, known by the name of "Hazelett casting", is described in particular in French patent specification Nos. 1,218,995, 1,276,413 and 1,314,592. With such processes it is possible to cast strips having a width which may be almost as much as two meters, and a thickness of the order of 10 mm. On account of the large surface area of the bands in contact with the liquid metal and the large heat exchange capacity resulting therefrom, the production outputs are considerable and may reach 30 tonnes/hour in the case of aluminium.

Another direct casting process involves casting between successive ingot mold elements wherein the liquid metal is cast between two series of elements or blocks separated and mounted one behind the other on an endless chain in the manner of a caterpillar chain.

These successive blocks may be cooled by the internal circulation of water, or consist of a solid block thermally insulated from the chain carrying them. In the latter case the blocks or molds act as heat accumulators; after they have left the casting zone they are cooled by spraying with water.

An illustration of the first technique is provided by the Hunter Douglas process, which is the particular subject of French Pat. No. 1,041,807. The second technique is illustrated by the Prolizenz process, which is the particular object of French Pat. No. 1,582,915.

The output rates of such machines are between those of continuous casting between cylinders and those of continuous casting between strips, and are about 10 tonnes of aluminium per hour.

A further direct casting process involves casting between wheel and strip wherein the liquid metal is cast in the interior of the groove of a wheel closed by a metal strip, most often of steel. This process tends to be used in the casting of bars to manufacture wire rods by subsequent rolling, rather than in the casting of blanks for the manufacture of large sheets. In fact, the lack of rigidity in the strip closure means prevents strips of sufficiently uniform thickness greater than about 300 to 400 mm being obtained.

Processes of this type used in the casting of blanks intended for the manufacture of wire rods are fairly numerous. The principles were developed by Properzi (in particullar French Pats. Nos. 981,897 and 1,029,354), Societe Nouvelle Spidem (in particular French Pats. Nos. 1,575,686 and 2,112,091) and Southwire Corporation (in particular French Pats. Nos. 1,497,742 and 2,183,858).

The output of these casting machines, which cast between a wheel groove and a strip is considerable, since a bar for wire rods having a relatively small cross-section may be cast at an hourly output of the order of 5 tonnes/hour.

Although these first three processes are very advantageous on account of the appreciable time reduction they provide in the treatment cycles of the finished products by eliminating or reducing the hot working operations, they nevertheless have some disadvantages.

First, they are not very flexible, and in fact the most adjustable industrial application is the production of wire rods by the third of these processes.

Second, they do not solve the problem of prolonged contact between the cast metal and the walls of the ingot mold, which latter either consists of two strips, from the elements of successive ingot molds, or a wheel and a strip. This problem is as follows: at the point where the feed takes place the liquid metal occupies all the space defined by these elements, for example the two metal strips forming the ingot mold. A rapid cooling and solidification of the parts of the cast metal in contact with the strips then takes place, accompanied by a contraction which detaches the solidified crust of the cast metal from its support.

The heat exchanges between the cast metal and the elements constituting the ingot mold are then more or less eliminated. In the case of alloys, refusion of certain fusible eutectics which exude across the solidified layer and set against the walls of the elements constituting the ingot mold may then take place.

These exudations, which are of a composition which is sometimes very enriched in addition elements, are a source of difficulty during the subsequent transformation. This explains why in the case of aluminium alloys, the processes described above can only be used for pure aluminium or alloys containing very small amounts of elements other than aluminium, such as AMl aluminium-manganese alloy and aluminium magnesium alloys containing less than 3% of magnesium.

A third disadvantage is that in the majority of these processes, and particularly in those where the linear casting rate is large, the depth of non-solidified metal in the center of the blank may be large. The result is that cavities or pinholes are formed in the center which are not filled by an input of liquid metal since the shape of the solidification front is very pointed and sharp.

Fourth, the cooling surfaces are finally poorly utilized, since between them and the metal an air film forms during solidification which acts as an obstacle to exchanges.

During the solidification of the metal it is thus advantageous to compress the cast product so as to avoid the disadvantages mentioned above, whence the idea of a fourth method, which has also been carried out industrially.

This fourth method involves casting between cylinders of the cooled rolling mill cylinder type. The supply of liquid metal may take place from below upwards, the axes of the cylinders then being in the same horizontal plane. This is the Hunter system, described in particular in French Pat. No. 1,189,838. It may also take place horizontally, and in this case the plane containing the axes of the two cylinders is vertical. This system is described in French Pat. No. 1,198,006 (Coquillard).

These systems avoid the defects of pinholes, segregation and exudation mentioned above, and enable thin strips to be cast (4 mm and above, and fairly long, at least up to 1.70 meters). However, these processes have two disadvantages. First, the contact surface between the cylinders and the product is small, which reduces the possibilities of heat removal. This surface area is roughly proportional to the square root of the radius of the cylinder. The hourly output of the machine is thus reduced. Second, the cast product is not kept laterally, which is not very serious for the casting of relatively large and not very thick sheets (1500 mm × 6 mm for example), in which the edges, which are first and foremost solidified, contain the metal more or less perfectly at the sides.

All the processes which have just been described thus have all the disadvantages falling in one or more of the following categories: (1) interruption of the transformation cycle, involving preheating, storage and additional preparation work; (2) the surface quality is sometimes poor as a result of segregation and exudation; (3) internal defects of the pinhole or crack type; and (4) very low production capactiy in certain cases.

The object of the present invention is to provide a process and apparatus for casting liquid metal in an ingot mold consisting of cooled, movable walls, which enables: (1) a large heat exchange surface area to be obtained between the metal and the ingot mold; (2) constant contact to be maintained between the cooling surfaces, both main surfaces and side surfaces, and the metal during the solidification; and (3) a progressive retention and even a real "hot working" of the product during solidification, which eliminates internal segregation, exudation, pinholes and shrinkage holes, and cracks during the solidification.

In order to obtain these results, the ingot mold for casting consists of successive ingot mold elements constituted in the following way; the main walls of the elementary ingot molds consist of elements cooled by water circulation, and the successive movable elements are connected to the inlet and outlet pipes of the cooling water only throughout their contact with the metal.

To this end, means are provided enabling these elements (called shutters) to be connected tightly and impermeably to the water inlet and outlet tubes. These means comprise; means for accurately positioning the shutters so that the inlet and outlet openings of these shutters are strictly opposite the corresponding openings of the pipes; means for providing a tight, impermeable connection with the corresponding openings, for example by means by expanding joints; the whole system consisting of these openings and their connection arrangement being called a water valve box; and means for closing water circuits (valves) in order to allow and arrest the expansion of the joints and the circulation of water from the shutters. These valves are controlled by systems of pawls and cams which are integral with the shutters and the framework respectively.

Some practical operating examples will be illustrated hereinafter.

The side walls consist of retracting or tilting side sectors which disengage progressively during the casting and maintain contact between the metal and the walls of the casting ingot mold, and produce a gradual pressure on the metal during solidification.

This combination of characteristics; namely cooling of the moving ingot mold elements limited to the contact period with the cast metal, maintenance of the contact between the cooling surfaces and the metal during solidification by virtue of a system of retracting or tilting side walls, and progressive retention of the cast metal made possible by the retraction of these sectors; constitute the essential features of the invention, which, as will be described hereinafter, may be the subject of various embodiments and variants of execution.

Figure 6:
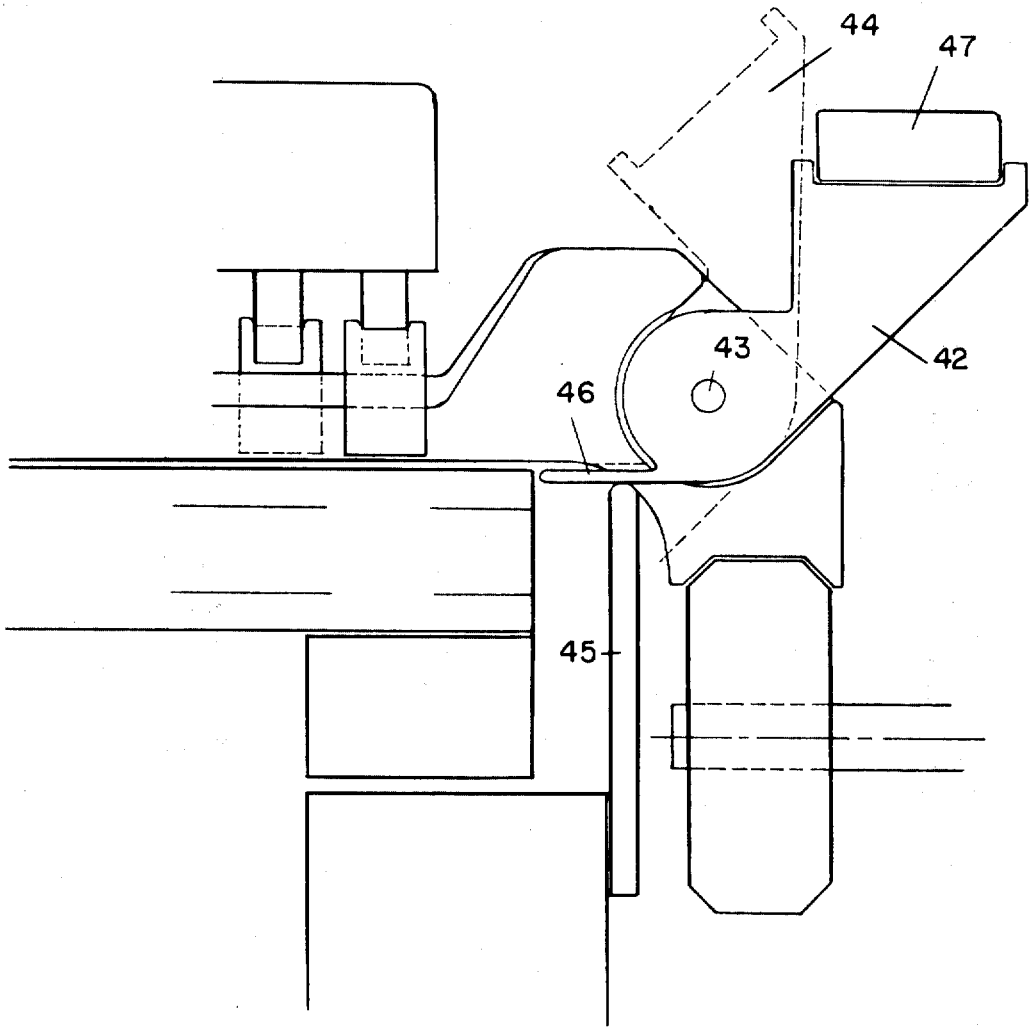
Figure 11:
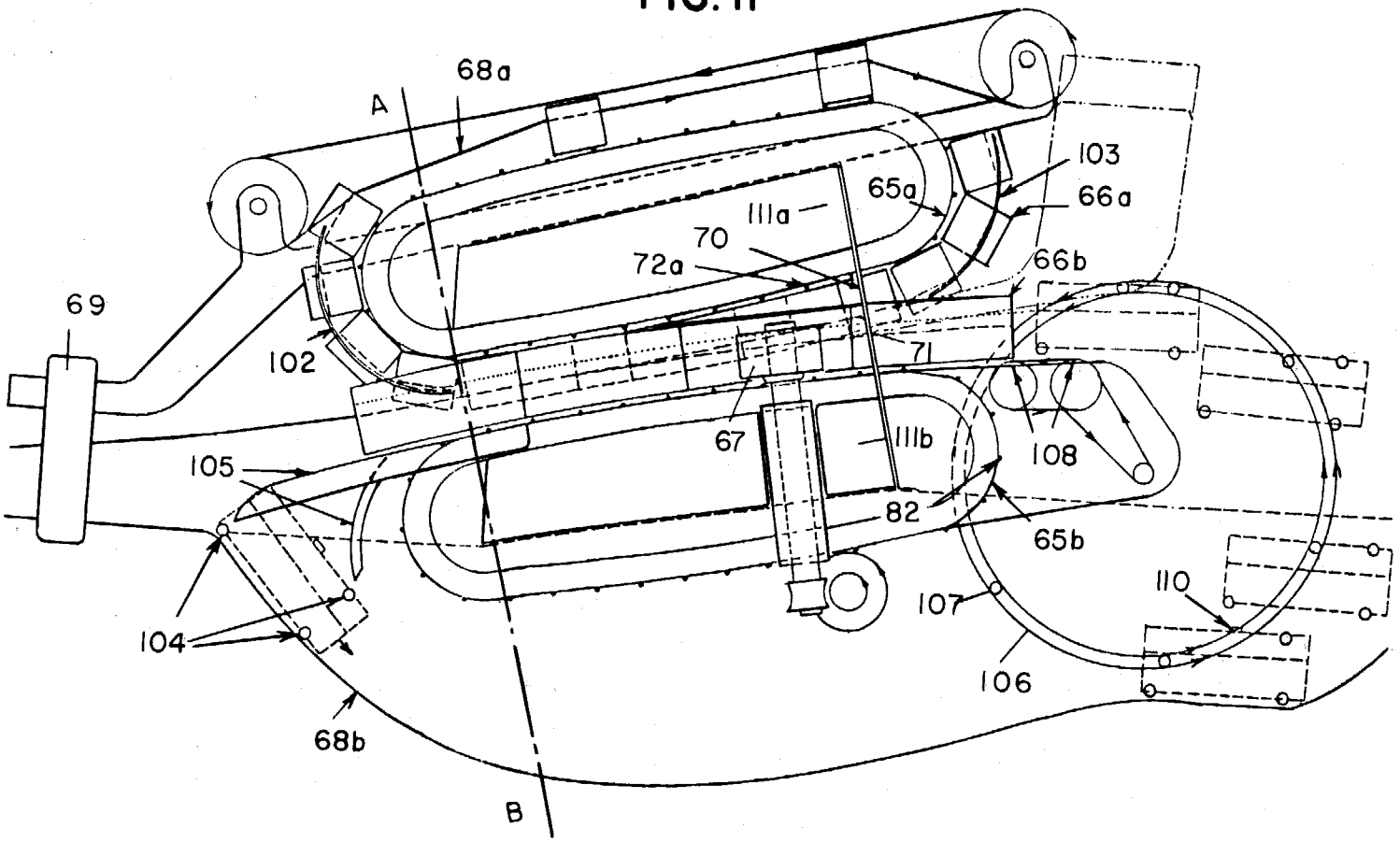
Figure 12:
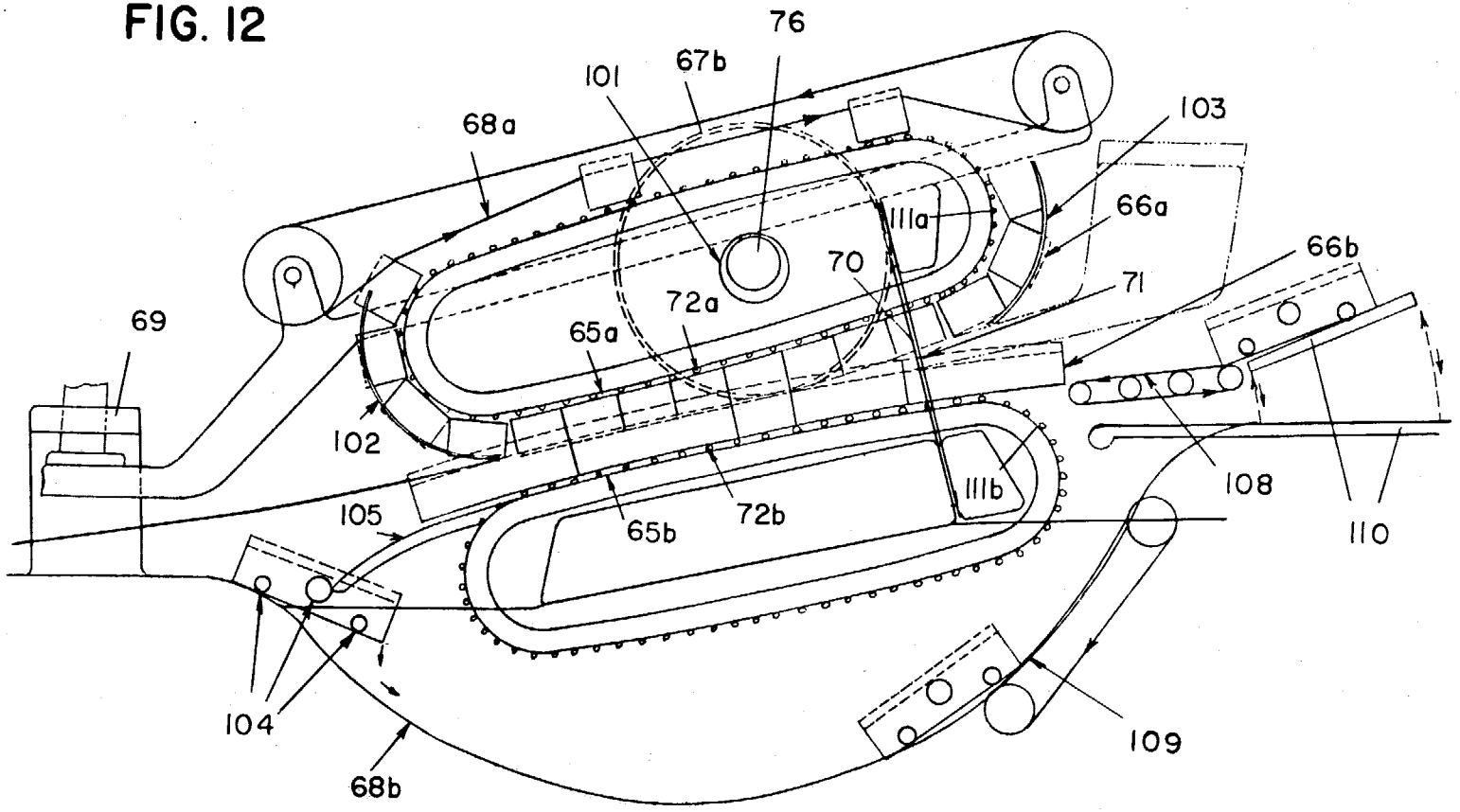
Figure 13:
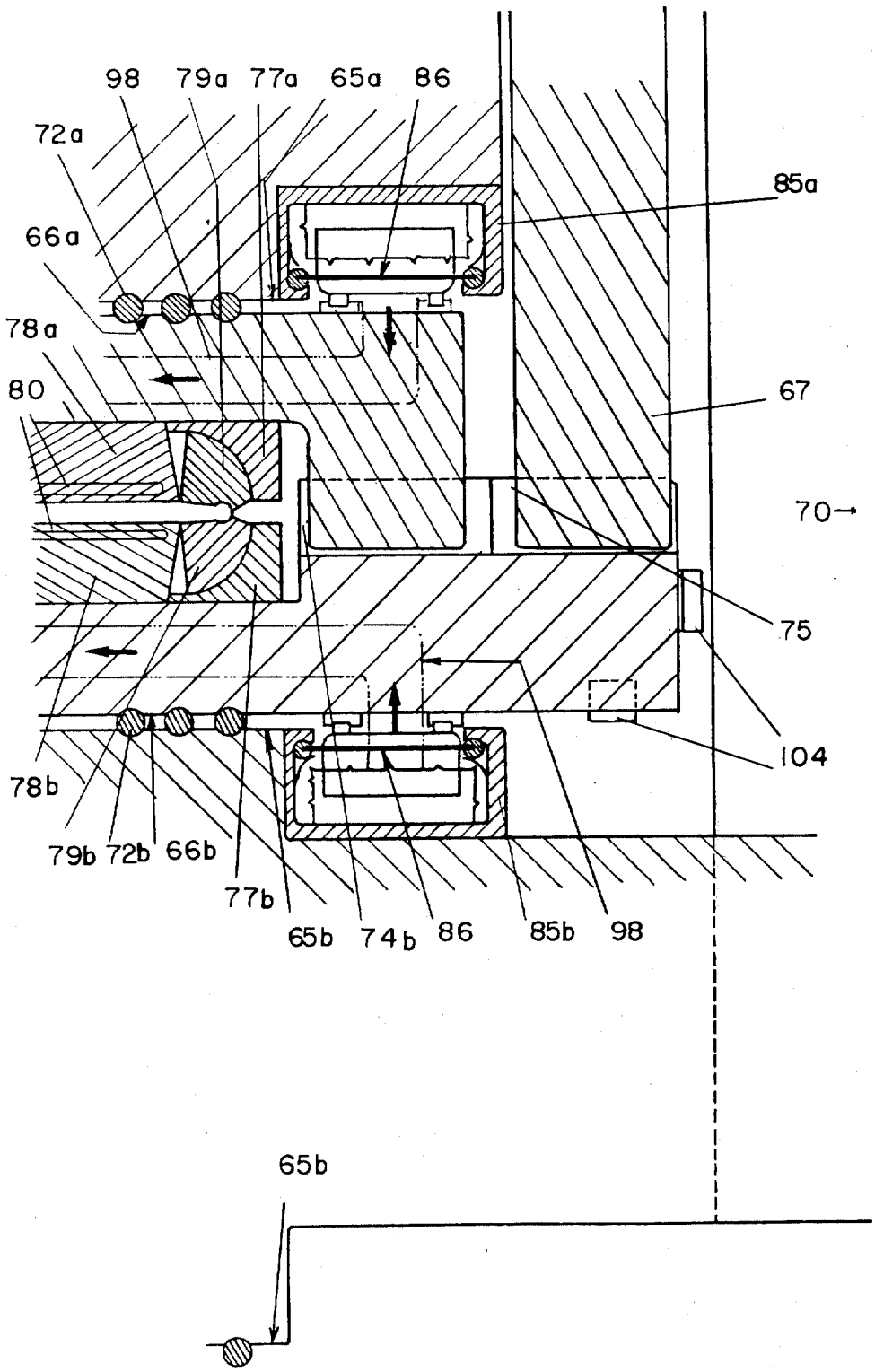
Figure 14:
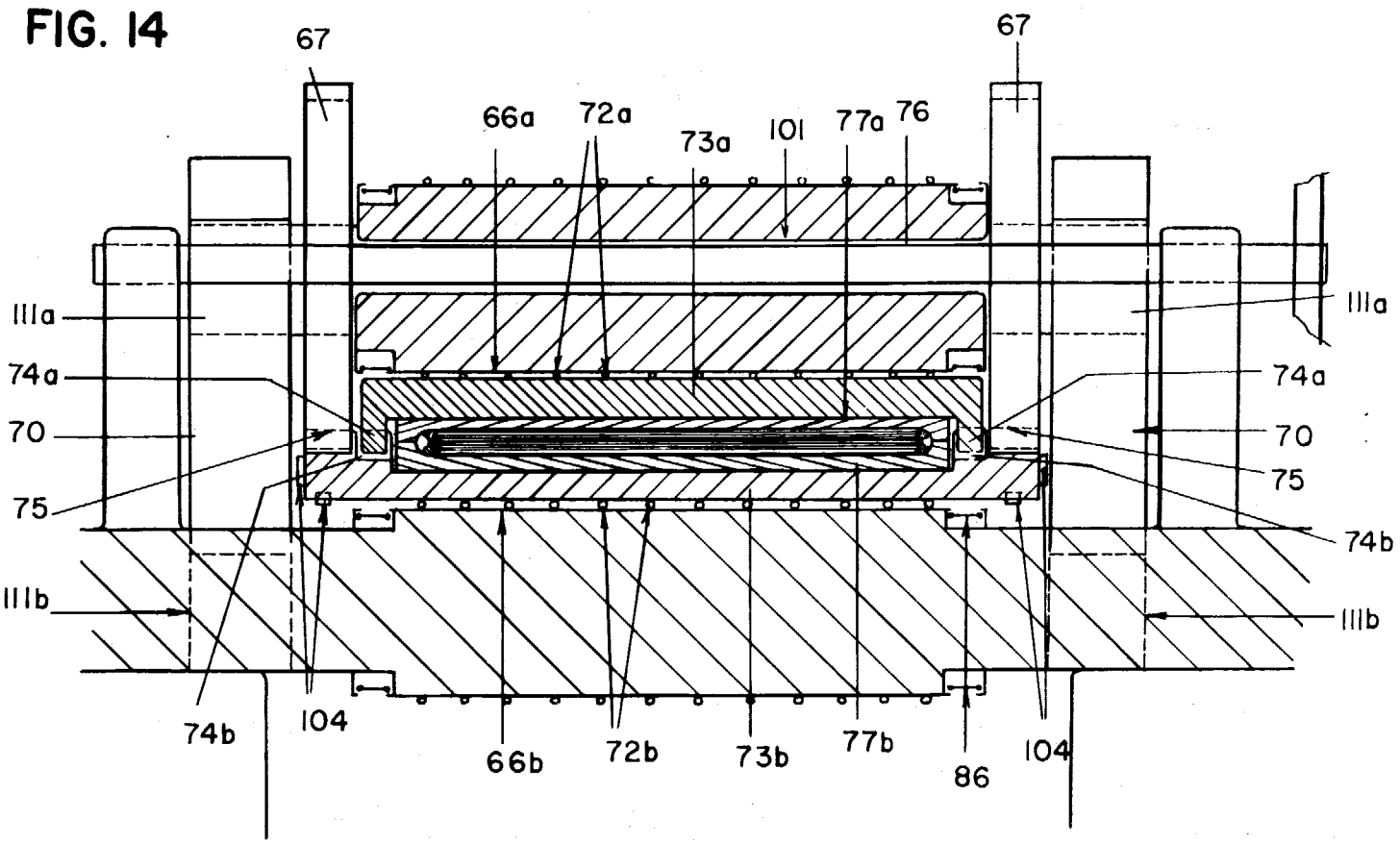
Figure 15:
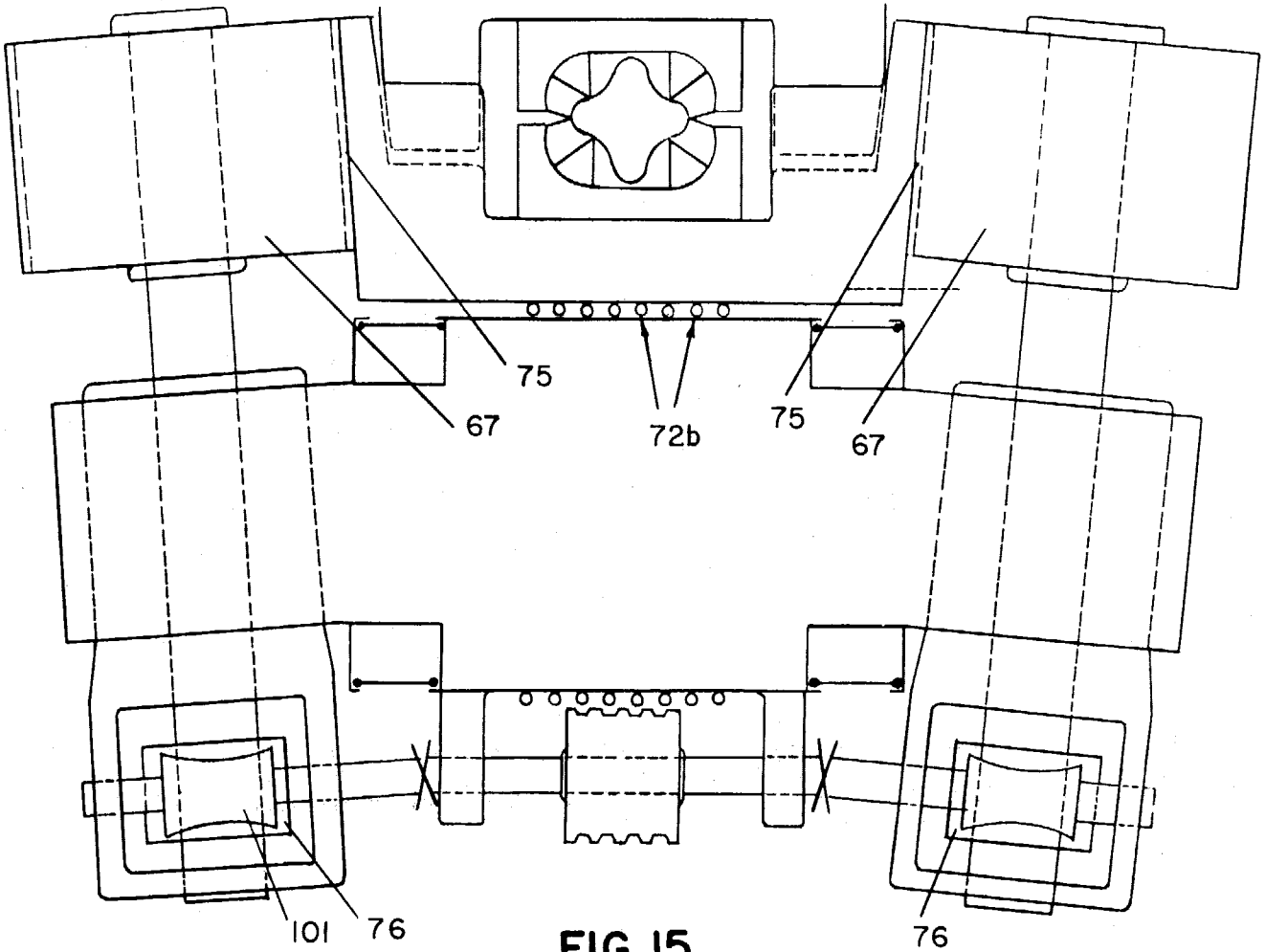
Figure 16:
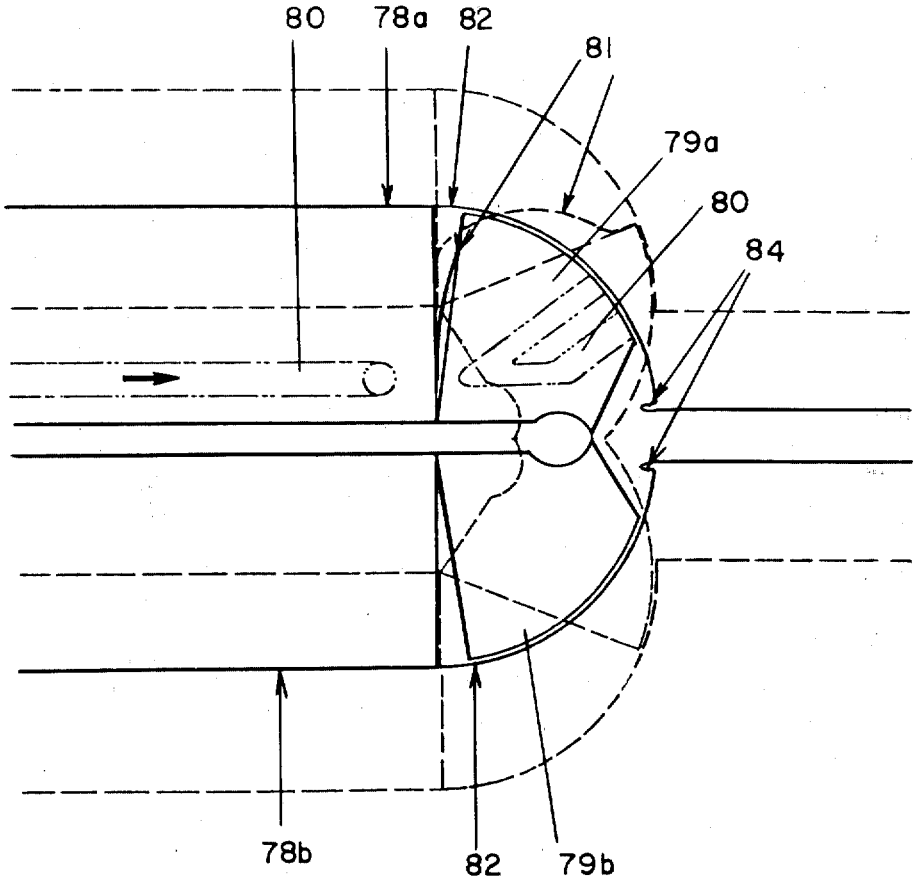
Figure 17:
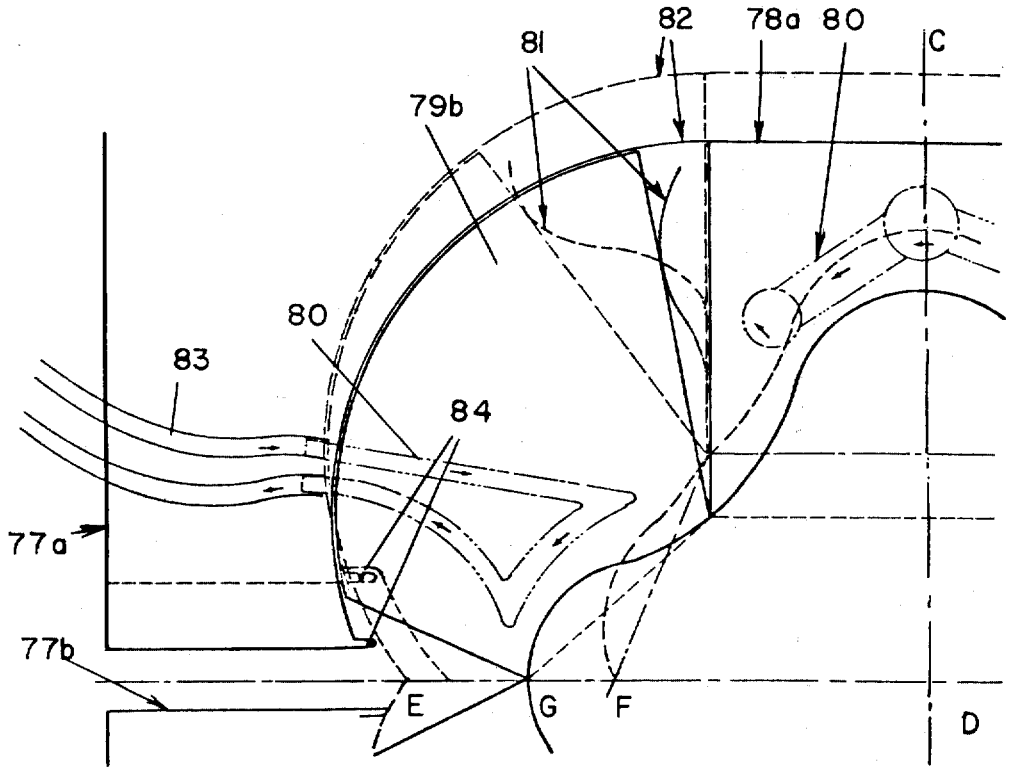
Figure 18:
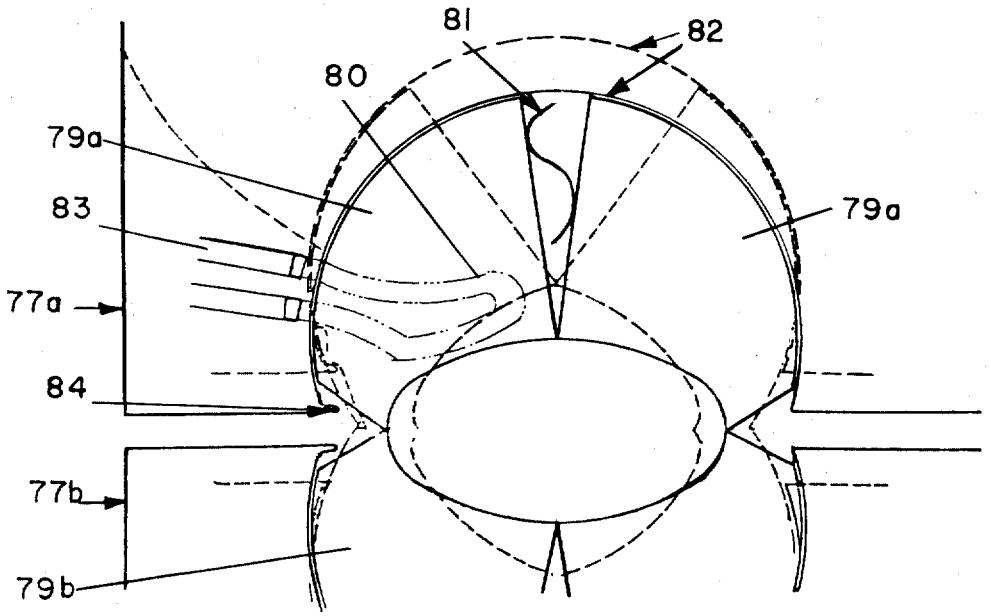
Figure 19:
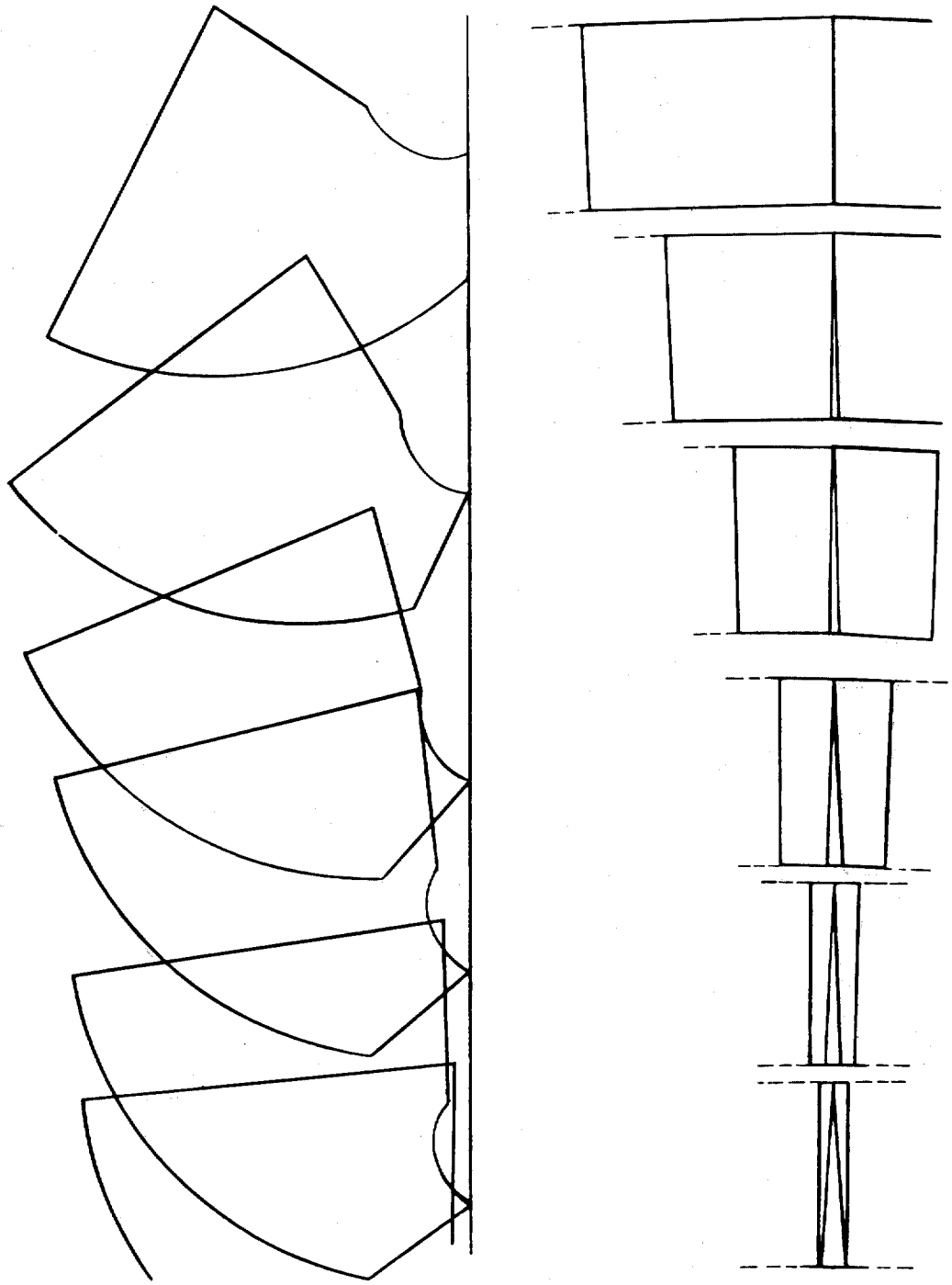
Figure 20:
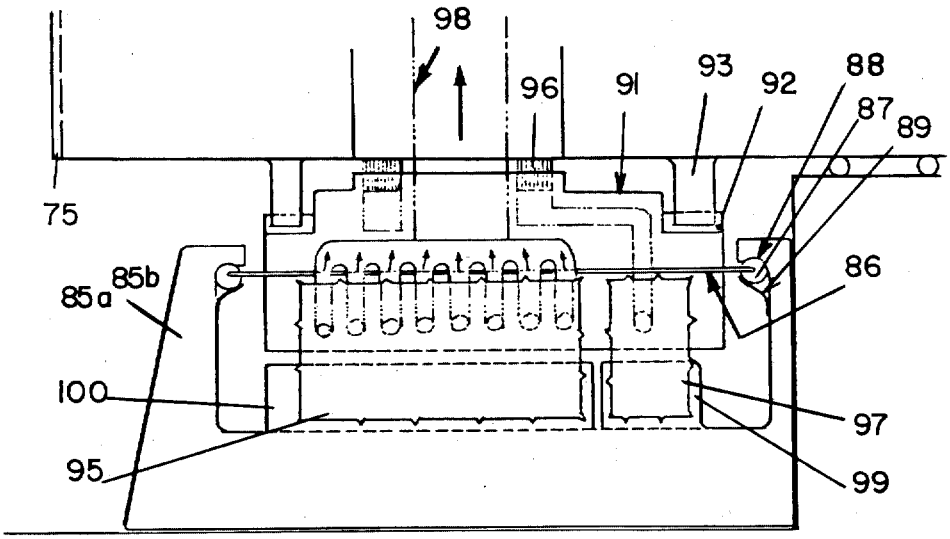
Figure 21:
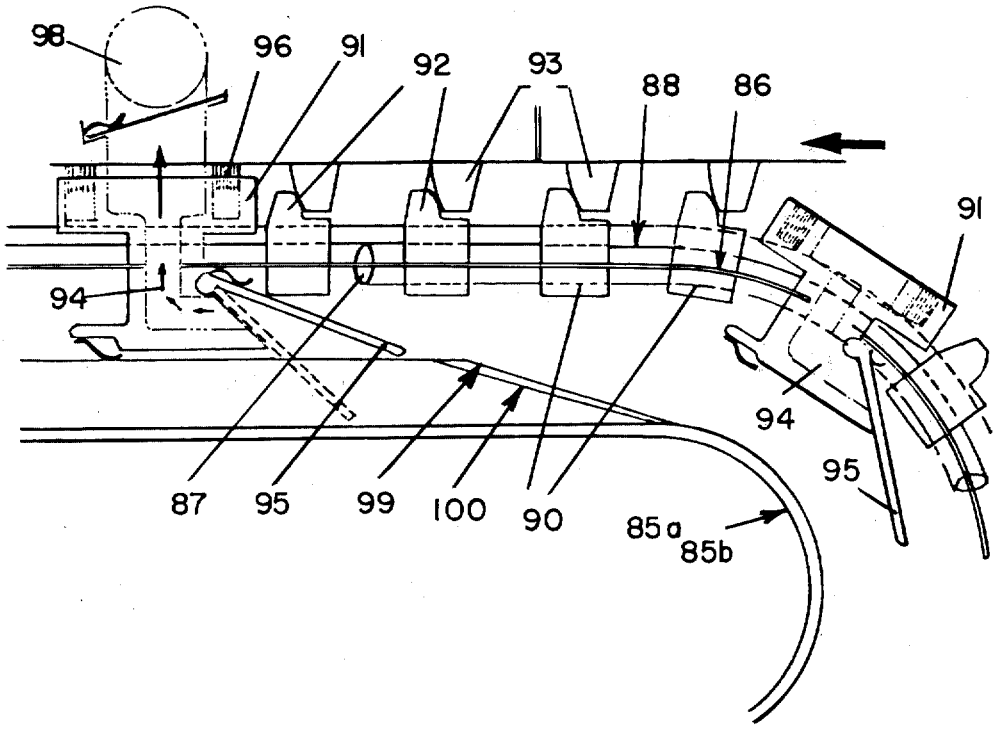
Figure 22:
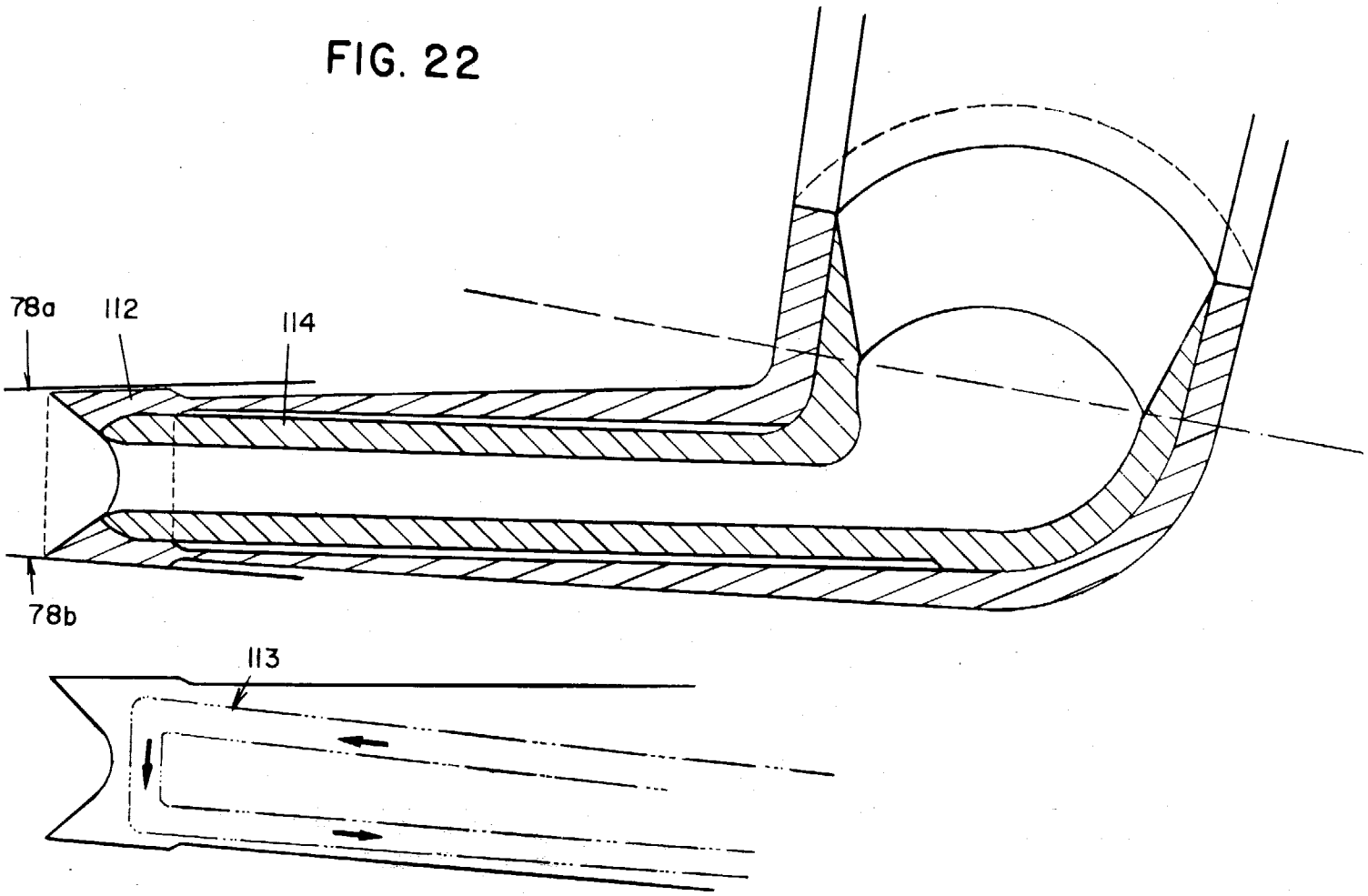
Figure 23:
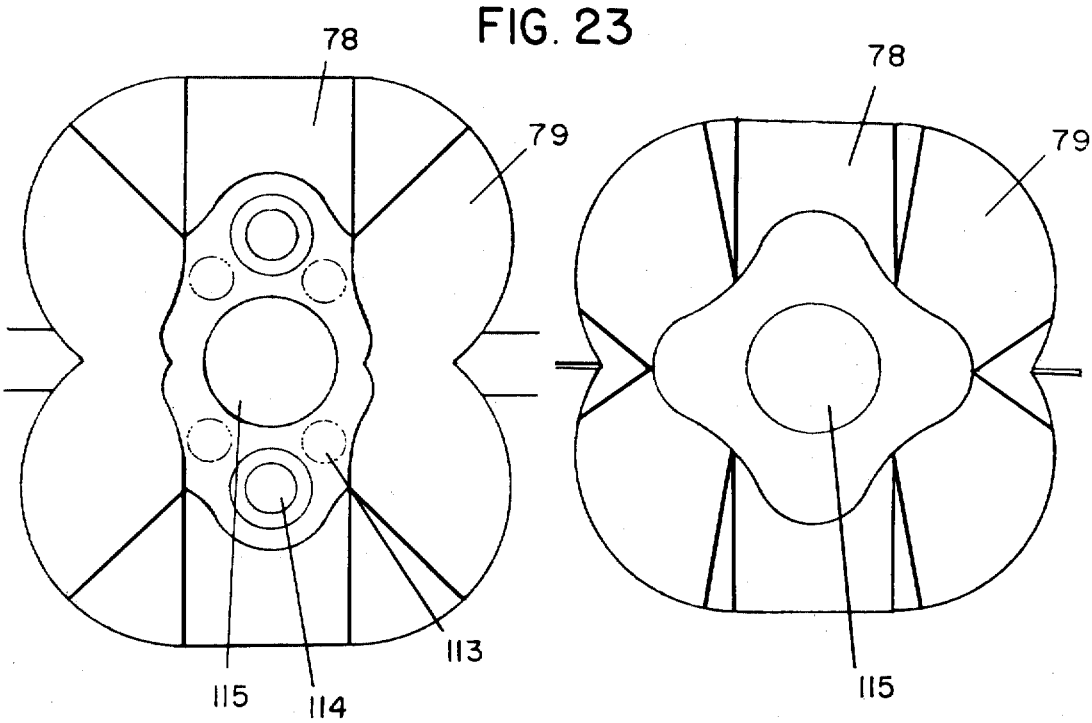
Figure 24:
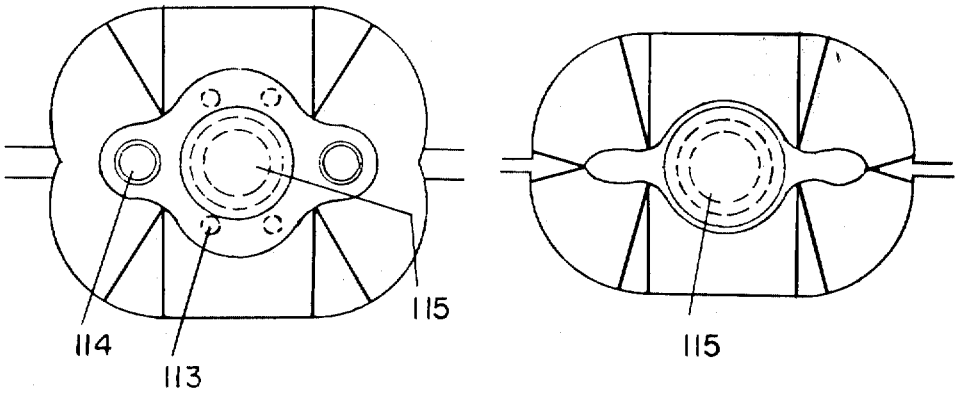
Figure 25:
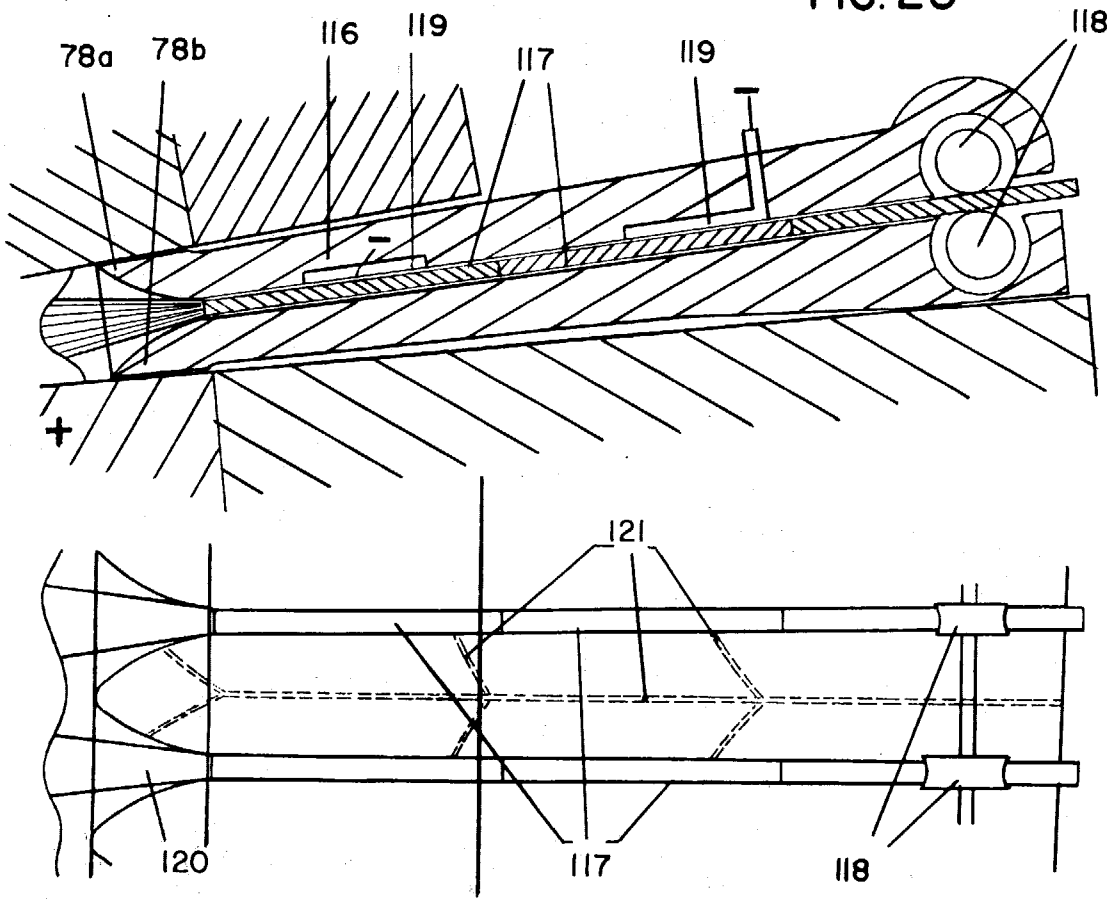

FIG. 6 schematically illustrates the pressure application system;

FIGS. 7, 8, 9*a*, 9*b*, 9*c*, 9*d* and 10 show particular applications of the apparatus of the preceding figures;

FIGS. 11 and 12 illustrate additional embodiments of the apparatus;

FIGS. 13 and 14 are enlarged transverse sectional details through the casting area and rolling pathways of the apparatus of FIGS. 11 and 12;

FIG. 15 is a schematic detail illustrating a portion of the drive mechanism of the apparatus of FIGS. 11 and 12;

FIGS. 16, 17 and 18 show variations in the shutter components;

FIG. 19 schematically illustrates the various positions of one form of tilting sector;

FIG. 20 is a transverse sectional schematic detail through the lower water zone in the casting zone of the metal;

FIG. 21 is a longitudinal sectional detail through the same area as FIG. 20;

FIG. 22 schematically illustrates the liquid metal feed system;

FIGS. 23 and 24 schematically illustrate additional forms of mold components; and FIG. 25 is a schematic illustration of a feed nozzle made of a refractory and insulating material.

Referring now more specifically to the drawings, a first variant consists of a casting machine in which the moving ingot mold is formed by a cooled rotating drum carrying the retractable side sectors and a collection of joined shutters having their axis parallel to the axis of the drum and surrounding a part of the circumference of the drum. These shutters are situated opposite well-defined points on the drum. They are also cooled by the circulation of water and, rotating at the same rate as the drum, form, together with the external surface of the latter and the side sectors, the casting ingot mold.

In this variant the metal is thus cast between a convex, moving, cylindrical surface which is the drum, and a concave, cylindrical surface consisting of the successive shutters.

The progressive retention is ensured by a system of cables or chains which urge the shutters against the cast product. Finally, an auxiliary mechanism ensures the resetting of the shutters after the exit of the cast metal.

Figure 1:
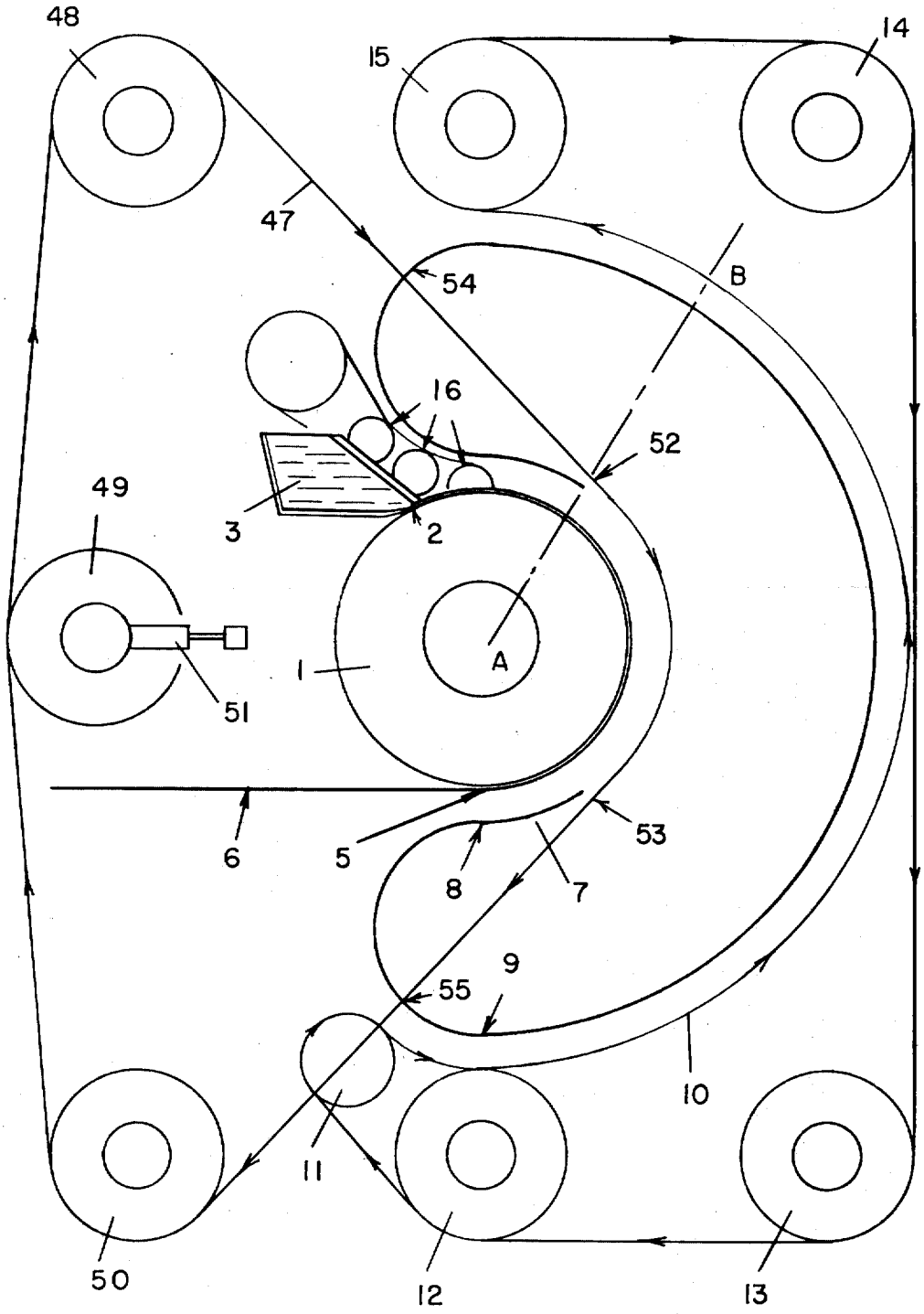
FIG. 1 is a schematic illustration of the invention.
Figure 2:
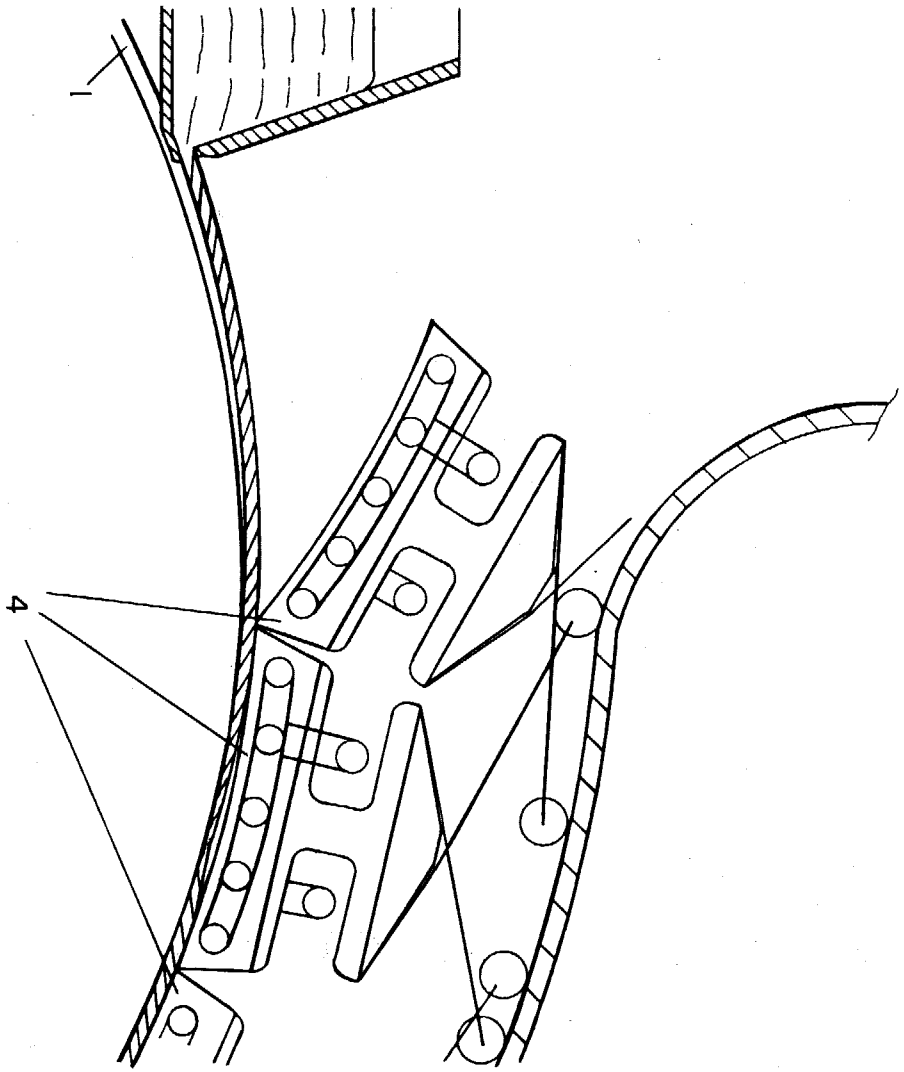
FIG. 2 is an enlarged schematic illustration of the casting drum and shutters in the vicinity of the liquid metal supply.

Before giving a detailed description of the various parts constituting the machine, it will first of all be preferable to understand its overall operation and for that it is necessary to refer to FIGS. 1 and 2.

Casting is performed in the following manner:

The casting wheel or drum 1, which is driven by a motor, rotates at a constant velocity. At the point 2 it receives liquid metal coming from a casting trough 3.

In the immediate vicinity of the supply the liquid metal is then kept in shape between the casting drum 1 on the one hand and the shutters 4, shown only in FIG. 2. These largely connecting shutters cover the cast product from the liquid metal feed 2 to the exit of the solidified product 5 and constitute the face of the moving ingot mold opposite that formed by the external surface of the wheel.

As the wheel turns and the shutters progress at the same angular velocity as the wheel, shutters must be brought to the liquid metal feed point 2 and withdrawn from the exit point of the cast product 5.

For this purpose, a rolling path 7 is used on which the rollers carrying the shutters move via elastic members. The circuit of a shutter is thus as follows; from the moment when, at 8, it leaves the cast product coming from the wheel at 5, under the influence of its own weight it rolls following the rolling pathway, from the point 8 to the point 9. Having arrived at 9, it is driven by a belt, a cable or any other system 10, which by simple clamping or by means of drive teeth and cogs lifts it to its upper part, following the rolling pathway 7. This belt or endless cable 10 passes over the pulleys 11, 12, 13, 14, and 15, one of which is a drive pulley, pulley 12 for example. However, the velocity of this belt is absolutely independent of that of the wheel: it may advantageously even be much greater, which means that only a few extra shutters compared with those operating between the points 2 and 5 are required. It should therefore be understood that the shutters are appreciably connecting only around the casting wheel between the points 2 and 5, but no longer over the rolling pathway 7.

When the shutter arrives at the upper part of the rolling pathway it tilts under its own weight towards the liquid metal feed point 2 behind the preceding shutter, as shown diagrammatically in FIG. 2. The rollers 16 enable it to be arranged parallel to the axis of the drum; the last inlet side train of rollers 16 is the drive, which gives the shutters a velocity equal to the velocity of the wheel as long as the relay is not engaged by the tension chains or cables. The shutters first of all rest on the lateral sectors carried by the drum. The cast cross-section is thus determined by the shutters, the external surface of the drum and the lateral sectors. From point 52, clamping chains or cables 47 encircle or hoop the whole of the system of shutters while the lateral sectors are drawn aside. All the pressure transmitted by the cables or chains 47 is thus exerted on the metal during solidification. At point 53 the clamping cables no longer act on the shutters which, having arrived at 8, fall under their weight to 9. The clamping chains or cables are driven by one of the pulleys 48, 49, 50, which is a drive pulley and drives the cables at a velocity synchronized with that of the wheel.

After this explanation of the overall operation of the machine, it will be useful to give some more detailed explanations of the particular realization of the invention which constitutes this machine. These explanations will deal with, in succession, the basic elements of the invention, namely the casting drum or wheel, the shutters, the clamping system, the lateral sectors, and finally the supplementary mechanism constituting the raising system for the shutters.

The casting wheel or drum constitutes, in its external part, one of the sides of the casting ingot mold which will receive the liquid metal. This external part should therefore be cooled by the water circuits indicated by 25*a* and 25*b* in FIG. 3. These circuits 25*a* and 25*b* are obviously in a plurality and are distributed at regular intervals along the circumference of the drum. The supply to these circuits is provided by a general water inlet 20 and a general water outlet 21 for cooling water, both of which are situated on the axis of the wheel.

Water valve boxes 27 and 31 serving to supply the shutters with cooling water are arranged at each end of the drum and over its circumference, at regular intervals corresponding to the width of each shutter. These water valve boxes will be described hereinafter.

A series of peripheral slots which enable the shutters to be precisely positioned are provided towards each end of the drum but closer to the center thereof than the water boxes.

The shutters which combine with the drum to form the moving ingot mold in the interior of which the liquid metal is cast have three main special features; a placement system with respect to the drum, a cooling system, and a clamping system on the drum.

The placement system with respect to the drum is absolutely necessary for two reasons: the first is the necessity to ensure a substantially interconnected succession of shutters in the casting zone, and the second is to ensure the coincidence of the water inlet and outlet orifices of the drum and shutters. It will in fact be explained hereinafter that the shutters are cooled by a circulation of water coming from, and returning to, the drum.

This placement of the shutters is effected in two directions, namely parallel to the axis of the wheel or width placement, and along the circumference of the drum.

Figure 3:
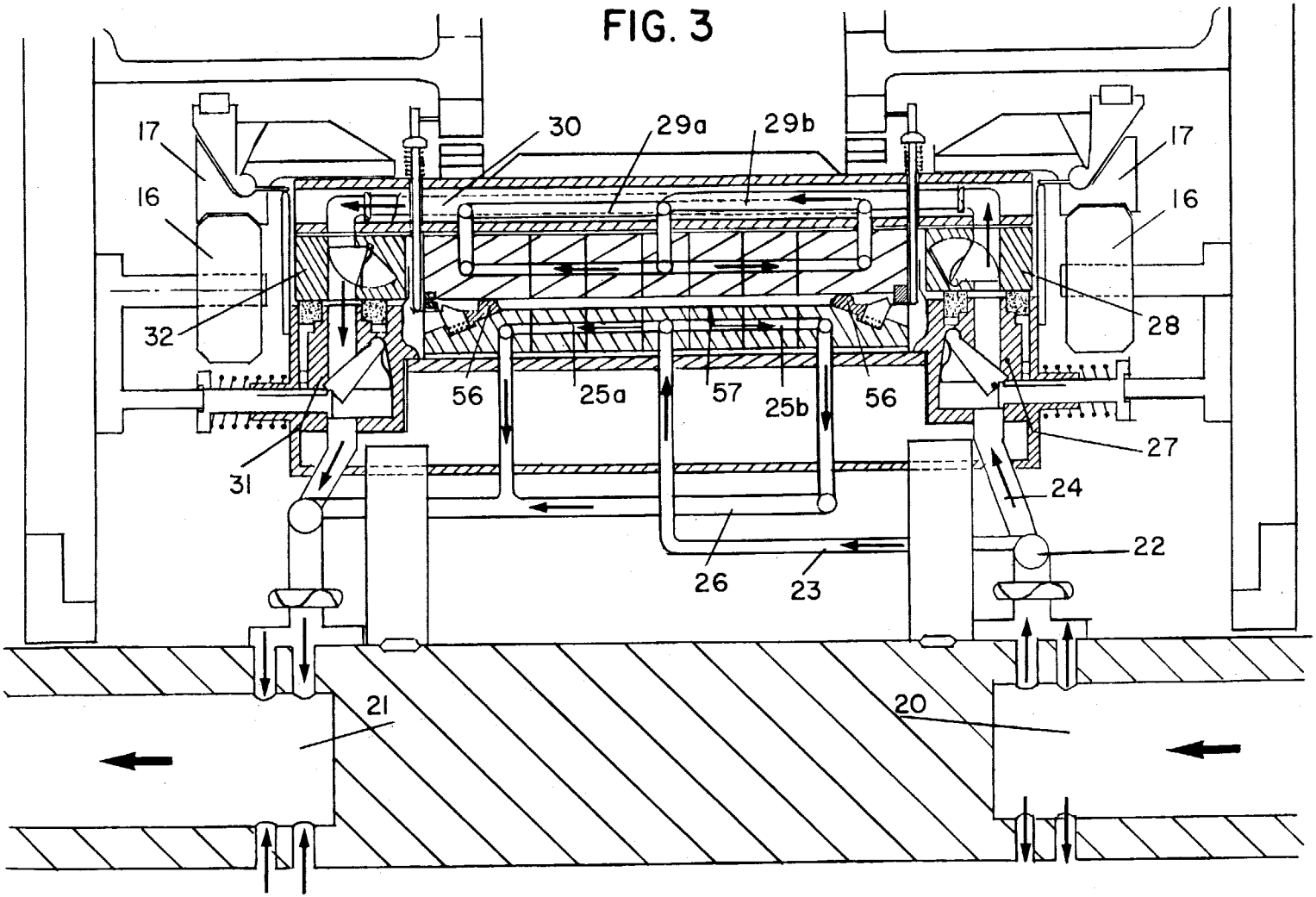
FIG. 3 is a cross-sectional view taken substantially on a plane passing along line A—B in FIG. 1.

The placement parallel to the axis of the wheel may for example be effected by the group of rollers 16, of which the last group, at the liquid metal feed level, is the drive roller. FIG. 3, which shows a section of the machine passing through the axis of the drum, clearly shows the rollers 16 and illustrates how their placement with respect to the rolling pathways 17 enables the corresponding shutter to be centered.

Figure 4:
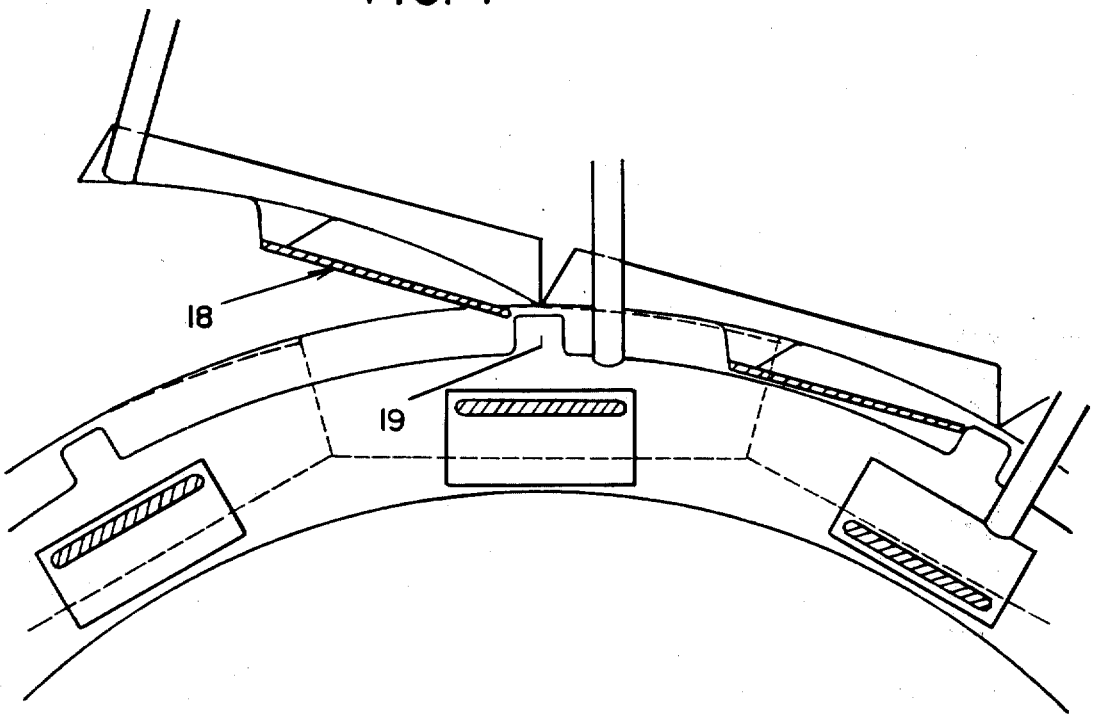
FIG. 4 is a schematic detail illustrating the positioning of successive shutters.

The placement of the shutters along the circumference of the wheel may be carried out according to the device shown diagrammatically for example in FIG. 4. Each shutter carries at each of its lateral ends a sort of small tongue or strip 18 which engages with teeth 19 machined on the two external peripheries of the drum.

At this point it is important to explain the purpose of these small tongues, for it might be though that they would be useless since the interconnected shutters are positioned correctly from the moment when the first shutters are positioned correctly at the start. In actual fact the shutters should not be perfectly joined, and there must be some play between them of the order of a few tenths of a millimeter, for the following reason: starting from a position of the drum such that a sufficient crust of metal is solidified, a clamping force will be exerted on the shutters, while at the same time the lateral sectors will be drawn back. The shutters will therefore be forced against the cast product, and the metal will contract and they will slightly come closer to the center of the wheel. A certain amount of play must therefore be left between them so as to avoid any overlapping or straddling at the moment of contraction. For thin products (about 10 mm), namely a wheel 1 meter in diameter and shutters 15 cm wide, there must be a play of about 2/10 mm between the shutters. This slight play is not harmful and does not produce any risks of infiltration of liquid metal.

Each shutter is provided with a cooling system consisting of a water circulation. Since this cooling system is closely connected with the cooling system of the drum, the two systems must be described together. The cooling system may easily be understood by referring to the cross-section FIGS. 3 and 5.

The drum is divided into as many cooling sectors as there are shutter emplacements on its periphery. The cooling water for the wheel and the shutters arrives via the axis of the wheel by pipe 20 and also leaves the wheel along the axis by the pipe 21. At the junction 22 the cooling circuit subdivides into a first circuit 23 for cooling the corresponding sector of the drum, and a second circuit 24 for cooling the corresponding shutter. The cooling circuit of the drum may be arranged as shown in FIG. 3, in which it can be seen that the supply 23 subdivides into two branches **25*a* and 25*b* passing in the immediate vicinity of the external surface of the wheel before rejoining the collector 26 and general outlet 21**.

The cooling circuit for the shutters is similar: the supply pipe 24 directs water through a double system of water valve boxes 27 and 28 in the two branches **29*a* and 29*b*; the water circulating in these two branches is then collected in the collector 30, passes through the water valve boxes 32 and 31, and rejoins the general exit 21**.

Figure 5:
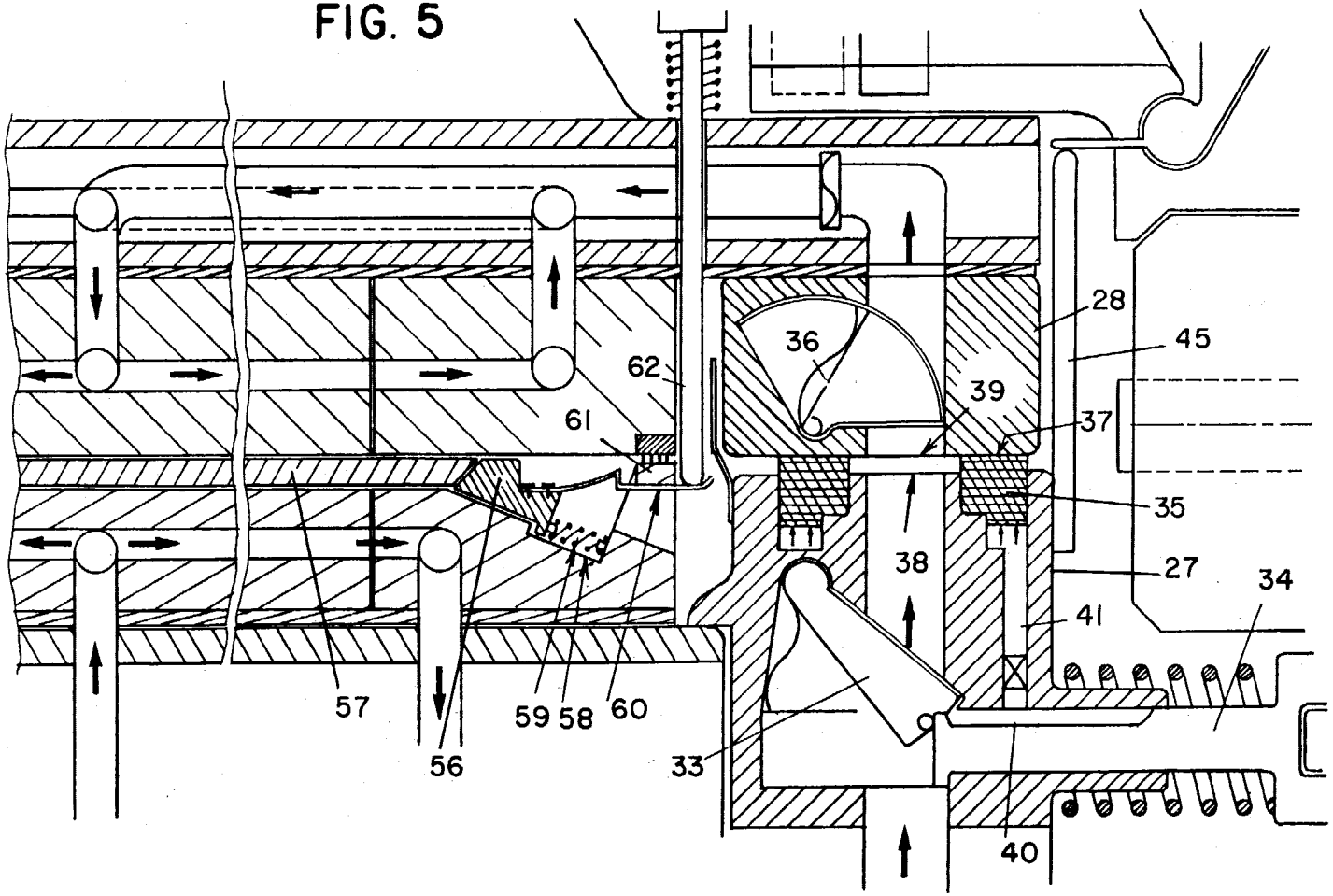
FIG. 5 is an enlarged view of a portion of FIG. 3.

FIG. 5 shows more clearly and in more detail the way in which the water boxes 27 and 28, and 31 and 32, are constructed.

The water valve box 27, which is integral with the wheel, basically comprises two elements; (1) a valve 33 provided with a spring which maintains it in the closed position as soon as the said spring is relaxed, a pusher 34 enabling this valve to be opened, and (2) a joint 35 which expands under the pressure of water.

The water box 28, which is integral with the shutter, also has two principal elements; (1) a non-return valve which only opens under a sufficient pressure of cooling water 36, and (2) a part of the flat and machined lower face 37 on which the expandable joint 35 engages, thereby ensuring impermeability between the two boxes.

This arrangement of water valve boxes operates in the following manner. Outside the casting zone the water circulates normally in the various sectors of the drum, and the valves 33, which are closed, prevent the water from flowing to the outside.

When the shutters, one after another, are positioned in the vicinity of the casting zone, at the exact position which the placement systems described above determine, the orifices 38 and 39 of the respective water valve boxes of the wheel and the shutter are thus opposite one another. A cam fixed to the housing of the machine then engages the pusher 34, which has a double effect; (1) the pressure of water is communicated via the groove 40 made in the pusher along the channel 41 to the joint 35, which expands and makes an impermeable contact with the plane machined surface 37, and (2) the valve 33 opens, the pressure opens the valve 36, and the water circulation is established in the shutter.

There is a similar device on the "outlet" side of the shutter.

This device has two advantages, firstly it ensures constant cooling of the drum even outside the casting zone, and it prevents any loss of water during the raising of the shutters, which could be dangerous in particular in the zone where the shutters are above the casting tank.

Finally, the shutters comprise a device enabling them to be clamped against the cast product after the lateral sectors have drawn aside, as will be explained hereinafter.

This device essentially comprises a pair of retractable stop means such as are shown in FIG. 6.

The retractable stop means may tilt about an axis 43 between a stable position indicated by the dotted line 44 and a working position indicated by solid line 42.

A suitable setting system, for example a spring, automatically restores this stop means to its stable position 44 when no opposing force is applied.

When the shutters come into contact with the wheel, that is to say slightly above the reference numeral 2 of FIG. 1, a system of pawls integral with the wheel and secured for example as shown in FIG. 5 reference numeral 45 to the water boxes of the wheel, acts on the pin 46 of the stop means (FIG. 6) and causes the said stop means to tilt from its stable position 44 to its working position 42.

The clamping system, which ensures a constant contact of the shutters against the cast product, consists of two cables, belts or chains, reference numeral 47, FIGS. 1 to 6, one at each lateral extremity of the shutter. Each of these endless cables, belts or chains passes over a series of pulleys 48, 49, 50, at least one of which, for example the pulley 49, is mounted on a shaft carried by a jack, enabling a certain tension to be communicated to the cables. In the casting zone around the drum, the cables, starting from the point 52, bear against recesses, in the part facing the wheel, of the stop means previously tilted into the working position as explained above. The bearing pressure of the cables is communicated via the stop means to the whole of the shutter and thereby ensures that the latter is clamped against the cast product.

The pressure of the cables stops from the point 53 where the cables being to move away from the wheel; then, slightly further on, at about point 8, the retractable stop means which are no longer subjected to the action of the pawls 45 return to their stable position 44, which enables the shutters to pass between the clamping cables and, at points 55 and 54, their path intersects that of the shutters.

In practice, with tension forces on the cables of the order of 10 tonnes, pressures of approximately 2 to 3 kg per $cm^2$ on the cast product are achieved. By using chains, pressures of about 20 $kg/cm^2$ on the cast product may be achieved by raising the tension of the chain to 50 tonnes and above.

Clamping of the cast product obtained can only occur from the moment when this product has acquired a sufficiently strong external solidified shape. The core of the product must still be liquid or at the very least pasty so that the pressure exerted by the shutters may effectively block the shrinkage holes, but the product must also have a sufficiently rigid external shape, especially on the small sides, so that it does not spread laterally when the pressure is exerted.

In the case of relatively large and thin products the liquid metal is poured without dropping at point 2 of FIG. 1 into a type of moving ingot mold consisting of the external surface of the drum and the successive shutters for the large faces of the product, and of the lateral sectors integral with the wheel for the small faces. These three elements form the walls of the mold into the interior of which the liquid metal is poured, and thus define the geometry of the cast product.

FIGS. 3 and 5 show very clearly the lateral sectors, reference numeral 56, which define laterally the dimensions of the cast product 57, which is a thin slab in the example shown in the figures.

It is clear that when the cast metal solidifies under the effect of the cooling circuits running through the wheel and the shutters, the thickness of the cast product decreases, this is the solidification contraction which, in the special case of non-alloyed aluminium, is of the order of 7%.

This means that if the lateral sectors remain in place the pressure exerted by the cables or chains described above would be exerted not on the cast product but on the lateral sectors since the shutters would rest on the latter and not on the cast metal.

A system must therefore be used which, at the desired moment, will allow these lateral sectors to draw aside and allow the shutters to rest against the cast product. This system may for example be in the form shown in FIG. 5. The lateral sector 56 is placed in a recess made in the rim of the wheel. A spring 59 maintains it in its high position or casting position. The lateral sector is extended by a flexible blade 60 which abuts against a pin or stop means 61. A pusher 62 carried by the shutter and sliding therein may, on descending, drive the flexible blade downwards and thus free it from the stop means 61. Under the influence of the pressure exerted by the shutter the lateral sector gives way and falls slightly towards the base of its recess 58, compressing the spring 59. The shutter then bears directly on the cast product.

The descent of the pusher 62 and thus the retraction of the lateral sector are controlled by means of a cam fixed on the housing of the machine and which can be displaced easily. It is thus simple to determine by successive tests the exact spot from which it is desired to control the retraction of the lateral sectors and the application of the pressure on the cast product. As soon as the pressure on the product ceases the spring 59 slackens and the lateral sector returns to its place.

All the metal parts in contact with the liquid metal or during the solidification should satisfy a certain number of requirements in order to prevent any rapid deterioration of these contact surfaces including high heat resistance at 200° to 300°, good thermal conductivity, and high elastic limit on heating.

In order to combine all these characteristics the ingot mold (drum, shutters, lateral sectors) may be made from copper alloys with good physical properties, for example cuproberyllium or a copper-cobalt-beryllium alloy.

The surface of the wheel, shutters and lateral sectors elements made of a low alloyed copper alloy may also be coated with a hard metal having a low coefficient of expansion such as molybdenum.

The auxiliary raising mechanism for the shutters does not require much explanation; it may for example comprise two notched belts which pass through recesses 17 serving to center the shutters.

After the description of a particular embodiment of the machine it is appropriate to give some specific details on the supply of liquid metal. In the case of thick products this does not present any particular problem, since all the systems used for supplying machines for casting between wheel and strip, between two strips, and between caterpillar tracks are suitable. For thin products it is convenient to refer to FIG. 2; the liquid metal feed is effected by pouring without dropping, in the vicinity of the upper generatrix but slightly above, from a charging tank the lower part of which is provided with a feed groove or a series of holes. The width of the groove and the height of the metal in the tank control the liquid metal flow rate. If the width of the groove is specified once and for all, it is possible to regulate the height of metal in the feed tank to the thickness of the cast product at the outlet of the wheel.

This casting process whose operation has just been described for the production of thin semi-finished products may also be used for the casting of ingots, plated metal, composite materials, ribbed strips, metal with inserts, and even castings.

Figure 7:
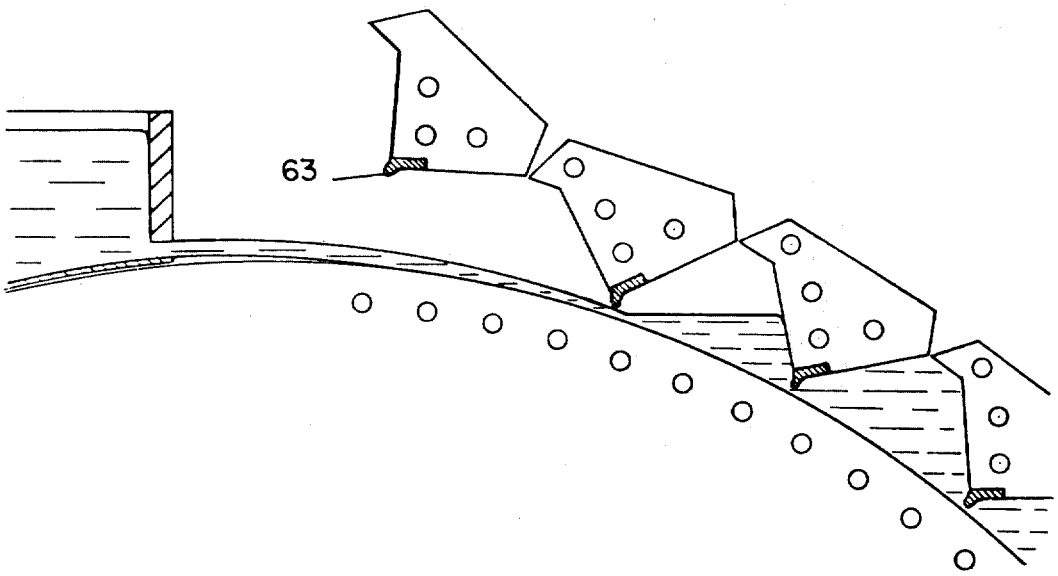

FIG. 7 shows diagrammatically a proposed device for the casting of ingots. The machine employs a drum having a useful length equal to that of an ingot, 70 cm for example, and the shutters contain a boss 63 in their center which reduces the thickness of the product to a few millimeters. The metal coming from the feed basin will have the shape of a sheet of liquid metal about 70 cm wide and a few millimeters thick, the velocity of this sheet being 5 to 10 times greater than that of the wheel. The level reached by the metal in the wheel is such that the shutters are applied thereto before this level is reached.

The ingots thus cast are then joined by thin bridges of solidified metal a few millimeters thick by a few millimeters wide. When the sheet of cast ingots reaches the lower part of the wheel, the metal bridges may be cut or their thickness may be reduced to less than 1 mm.

In this arrangement to ingots leave parallel to the axis of the wheel. The thickness of the thin sheet of metal which joins them is thin enough for them to be easily separated.

This device may also be improved by securing a material of a refractory element to the tip of the boss of each shutter. The cooling tubes are disposed so that they ensure an oriented solidification of the ingot, the upper part being hotter.

In this case the retraction of the lateral sectors and the pressure exerted by the cables reduce the thickness of the metal bridge between the shutters to less than 2 mm during the solidification. This retraction also reduces the shrinkage holes.

The output of such a machine depends on the dimensions of the wheel. For a wheel 1.30 m to 1.50 m in diameter it is normally of the order of 50 tonnes/hr. to 100 tonnes/hour.

Figure 8:
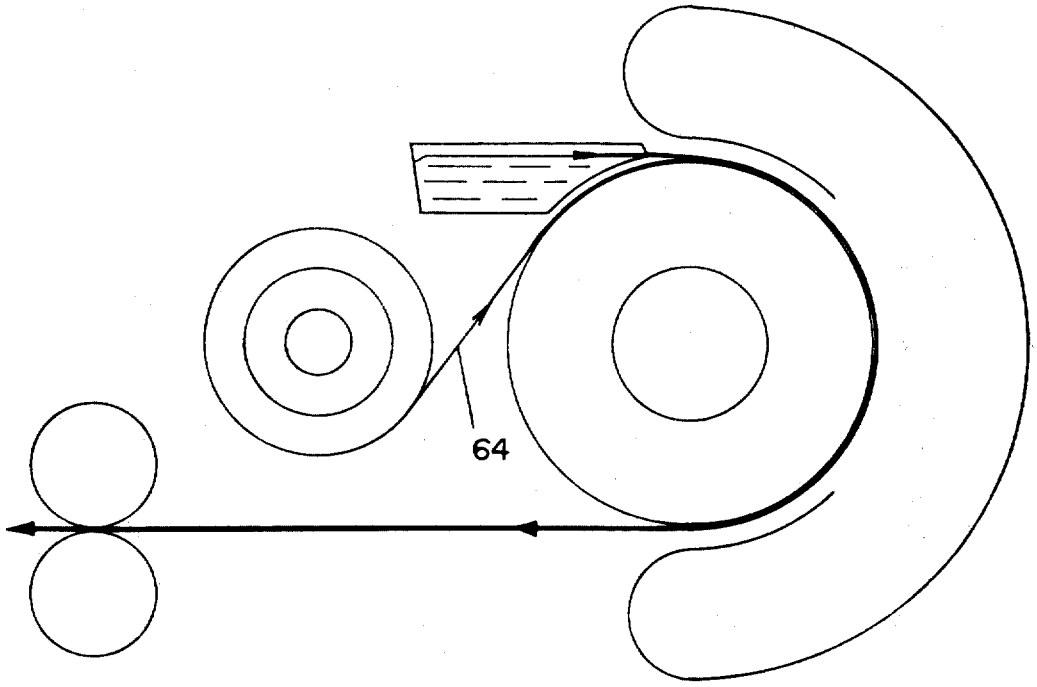

The outline of the installation for the production of plated metal is shown in FIG. 8. Metal feed from a basin situated above and upstream of the upper generatrix of the wheel can provide a simple solution for the manufacture of flat plated products. The plating strip 64 is held over the wheel at the outset and its external face is cooled by the wheel. The casting of metal on the strip and its solidification under pressure ensure a very good metallurgical continuity between the base metal and the coating layer.

Of the possible applications the following may be mentioned; strips coated to an extent of 5 to 10% of their thickness with an alloy ensuring cathodic protection with a bronze welding alloy and mixed aluminum-copper or aluminum-steel strips. This technique should even be all the more adapted to this manufacture since it accurately ensures the conditions of temperature, duration and pressure which are decisive as regards the metallurgical quality of the joint between the two metals.

The high degree of accuracy of positioning the plated layer makes it possible to plate narrow and parallel strips or cut-up or perforated strips in accordance with suitable designs for making decorative sheets after anodization.

The plating of different metals may benefit from the same possibilities of localization of this to certain zones.

The combination of plating a strip and inserting a network of filaments or fibers enables composite materials to be produced. A single-dimension or two-dimension filament network (of steel, carbon or boron for example) gives a product having exceptional characteristics.

Figure 9A:
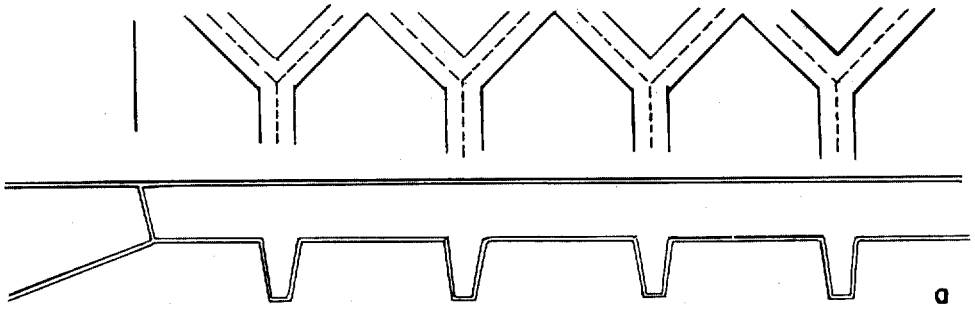
Figure 9B:
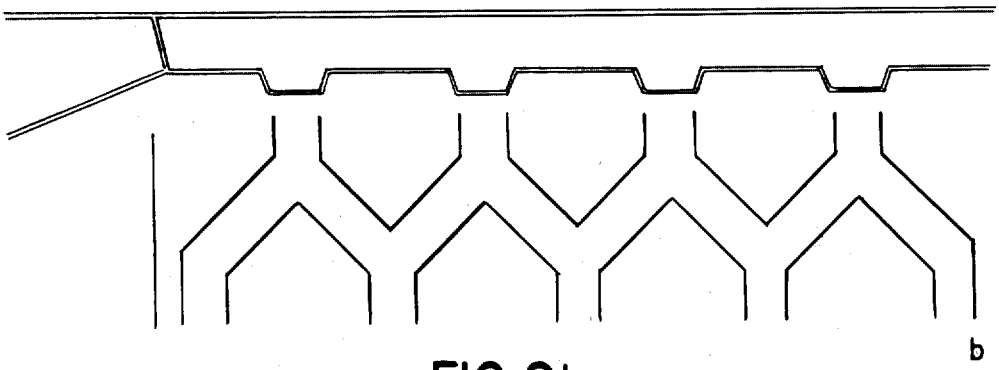

FIGS. 9*a* and 9*b* show a transverse section of the product on which the surface of the shutters is seen to be smooth, that of the drum is etched, and the lateral sectors can also be seen. The metal which feeds the rim above the high point of the wheel cannot descend into the grooves of the rim when they are either deep but sufficiently narrow, or wide but sufficiently shallow. The possible dimensions of these grooves depend on the casting parameters, namely nature of the alloy, thickness of the product, casting temperature, casting rate, etc. Applications include engraved strips, covering sheets, grooved strips.

Figure 9C:
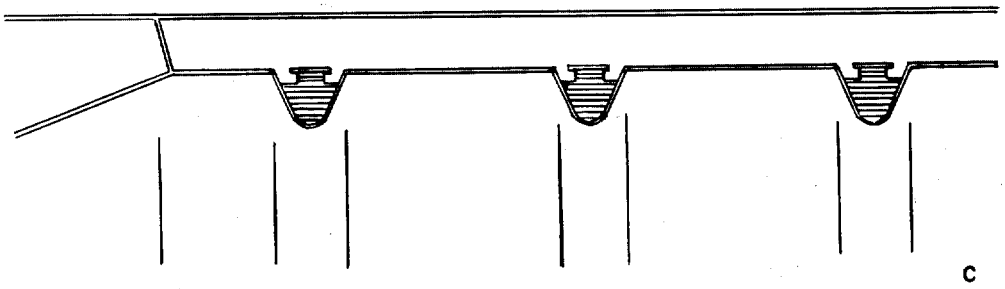
Figure 9D:
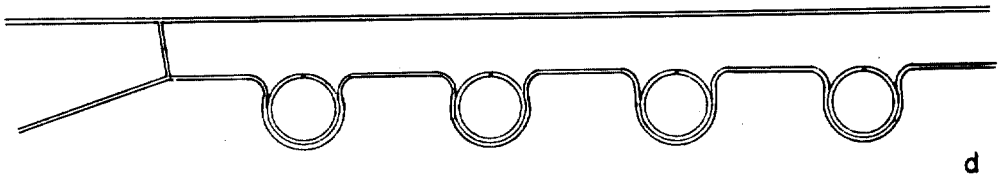

FIGS. 9*c* and 9*d* show that it is also possible to lay shaped metal sections in a continuous manner in grooves made in the rim of the wheel and cast the metal over the whole arrangement. Products whose ribs are shaped sections made of a light alloy or of other metals are thus produced. Applications include composite shaped conducting sections with a steel friction surface, special coverings, etc.

FIG. 9*d* shows in particular the transverse section of a product consisting of a series of tubes which are unrolled inside the grooves of the drum and which are embedded in the cast metal. Wide strips of indefinite length provided with inserts consisting of longitudinal tubes are thus obtained. Applications include heat exchangers, cryogenics, radiators, etc.

Figure 10:
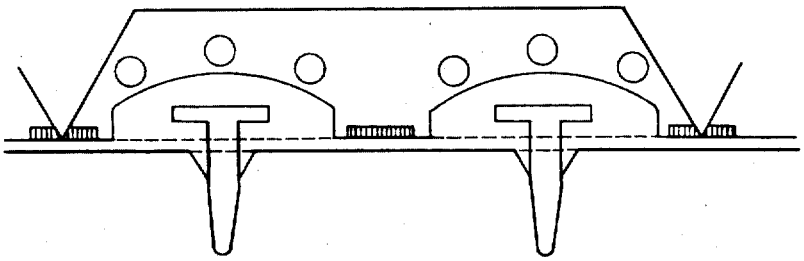

Finally, the technique of the casting wheel may also be employed in the mass production of simple articles normally chill cast. These articles may comprise inserts, and the only requirement is that they can easily be stripped. FIG. 10 shows how articles of construction hardware may be manufactured.

The parts of the "mold shutters" situated between the articles may normally be of a refractory material so as to facilitate subjecting the cast article to pressure during the retraction of the lateral sectors and the operation of the clamping cables for the shutters.

Pegs may also be provided mounted in the "mold shutters" and controlled by suitable devices fixed to the housing of the machine in order to intervene at specified points in the solidification process.

A second variant of the process which is the object of the invention consists in applying this system of successive elementary ingot molds to the casting between cylinders of very large diameter. In this case the casting of the metal is performed between two convex cylindrical surfaces and no longer between a convex cylindrical surface and a concave cylindrical surface.

However, this casting process involves the following means of the invention, namely the elements of cooled, successive ingot molds; pressure applied to the metal during solidification, and the presence of tilting lateral sectors enabling the pressure to be communicated to the cast product itself.

In the device in accordance with this second variant casting of the metal takes place between two cylinder elements of large diameter, for example 50 to 300 meters. However, since of course it is impossible to produce such cylinders only the element of this cylinder in contact with the cast metal is used, the said element consisting of a series of successive shutters of cylindrical shape. On the other hand, the cross-section of cast metal which decreases progressively in thickness from the feed point of the metal to the line joining the center of the cylinders is maintained laterally by a system of tilting lateral sectors.

The invention thus consists of a process for the continuous casting of semi-finished products, namely sheets, shaped sections and blanks, characterized by the combination of these two features, casting between two cylindrical surfaces of very large diameter and lateral maintenance of the cast product by virtue of tilting sectors.

The casting apparatus described in detail hereinafter which enables the aforementioned process to be operated also constitutes an object of the invention.

A schematic diagram in vertical elevation of a casting installation according to the process is shown in FIGS. 11 and 12.

The essential parts of the installation include; (1) the two upper 65*a* and lower 65*b* rolling pathways on which successive upper 66*a* and lower 66*b* shutters move, which carry the elements of the moving ingot mold. The parts facing the cast metal, that is to say the lower portion of the upper pathway and the upper portion of the lower pathway are cylindrical surfaces of large radius (50 to 300 meters), the centers of the cylinders being in the plane making a small angle with the vertical, shown on the diagram by the line AB. The casting of the metal thus takes place almost horizontally. (2) A drive mechanism 67 by gearing the lower shutters, which in their turn drive the upper shuttes by gear means; (3) Quick-return systems for the upper 68*a* and lower 68*b* shutters; (4) A clamping system for the two rolling pathways of the shutters. This clamping system comprises two large sheets 70 in the plane of the metal feed device, and a jack 69 below (downstream) of the outlet for the product. It enables the spacing between the two rolling pathways to be varied slightly by pivoting the latter about a dummy shaft 71 situated in the center of the feed device. (5) A liquid metal feed system.

The most complex part is clearly the unit consisting of the rolling pathways, the shutters and their cooling pieces, and the cooling circuit for the whole assembly. These various parts will now be described in succession.

The rolling pathways as such are shown in a longitudinal section in FIGS. 11 and 12, and in a transverse section in FIGS. 13 and 14.

They comprise two cylindrical bodies of horizontal generatrices of heights slightly greater than the width of the cast product and whose directrix curves, reference numerals 65*a* and 65*b*, have a convex circular cylindrical portion of very large diameter (50 to 300 meters for example) opposite the cooling zone, that is to say between the points 71 and the plane AB.

The pressure is applied to the cast product by means of various types of caissons or boxes, via the shutters which run on these caissons and thus constitute in the casting zone a mill roll portion of very large diameter.

If need be the lower cylindrical rolling pathway can be replaced by a flat rolling pathway, that is to say of infinite diameter.

The lower rolling pathway is fixed to the fixed frame of the casting machine; the upper rolling pathway is integral above the fixed frame of the machine via the large, strong sheets 70, and below by means of a moving support clamped to the frame of the machine through a clamp screw 69, FIGS. 11 and 12.

Finally, these rolling pathways carry longitudinal channels or grooves of suitable shape to allow bearings or rollers 72*a* and 72*b* to move therein, which are maintained in flexible supports and ensure movement of the shutters between the sectors with the minimum of friction.

The shutters are diagrammatically shown in cross-section in FIGS. 13 and 14. FIG. 13 shows on an enlarged scale the right part of FIG. 14. The sections are transverse for the casting machine but longitudinal for the shutters whose length corresponds to the width of the cast product and whose width is generally appreciably less for the upper shutters than for the lower shutters. The latter are in fact, for reasons which will be given hereinafter, 3 to 4 times wider than the upper shutters whose width, for example, may be approximately twenty centimeters.

Both the upper and lower shutters comprise, shaped tighteners 73*a* and 73*b* provided with drive teeth 74*a* and 74*b* at each end. These drive teeth, which form a gearing of very large diameter, enable the upper shutters to be driven by the lower shutters.

The lower shutters themselves comprise side toothed rack elements 75 driven by pinions 67 at each side. These rack and pinion systems drive the lower shutters and thus effect their progressive clamping between the rolling pathways.

The side pinions 67 and the toothed rack 75 carried by the lower shutter are either conical gear elements in which case the common vertex of the cones is the center of the cylindrical part of the lower rolling pathway, or cylindrical gears in which case the drive pinions 67 are integral with the motor shaft 76 which passes through the upper fixed cylindrical segment 65*a* in a cylindrical housing of oblong cross-section in order to be able to vary the gap between bearing segments and thereby the thickness of the final cast product.

The upper and lower shutters also comprise cradles 77*a* and 77*b* which support fixed cooling elements 78*a* and 78*b* and cooling elements in the form of tilting sectors 79*a* and 79*b*.

These fixed and tilting elements give the geometrical shape to the starting cast product. During the solidification the coming together of the fixed elements enables the thickness of the product to be reduced, while the tilting action of the elements 79*a* and 79*b* ensures the maintenance and lateral compression of the product.

The dimensions and shapes of these elements vary according to the type of cast product, through their operating principle is always the same. FIGS. 16, 17 and 18 show some embodiments.

FIG. 17 shows for example two successive transverse sections of one of the halves of a cradle and upper cooling elements. The whole of the upper part is symmetrical with respect to the axis CD.

The cast product is a shaped section of rounded cruciform cross-section intended for example to serve as a bar for the manufacture of wire rods.

The first section, shown in dotted lines, is made in the plane of the casting front and thus in a plane perpendicular to the casting direction passing through FIG. 11 and indicated by reference numeral 71.

The second section, shown in full lines, is made in a plane shown in FIG. 11 by its trace AB.

The fixed cooling element 78*a* in passing from the position of the first section to that of the second section moves only parallel to itself when approaching the lower fixed cooling element. It is provided with cooling channels 80 rigidly connected to the shutter since the element 78*a* does not undergo any relative displacement with respect to the shutter.

The tilting cooling element 79*a* has a double action; on the one hand it moves donwardly like the fixed sector, and on theother hand it turns towards the interior of its seating around the center of the circle formed by its external profile. Thus, in the plane of the first section, as shown by dotted lines, the two corresponding upper and lower tilting elements are applied by the springs 81 against one another over the face EF. As the distance between the shutters decreases the pressure of the two tilting sectors on one another forces them to tilt compressing the spring 81, while the angular interval between fixed and filting 82 sectors decreases. The upper and lower tilting elements are then only in contact at a single point G.

Since the tilting sector can move with respect to the shutter, the supply of water to these sectors from the shutters may be effected by flexible pipes 83 which move in channels in the cradle.

The tilting sector may also be made without any internal pipes if it is made of metal having suitably chosen mechanical and thermal properties. Cooling is ensured by its contact with the cradle in which it pivots, this cradle itself being cooled by a circulation of water in the same manner as the fixed elements 78*a* or 78*b*.

Finally, stop means 84, which bear against a groove machined in the tilting sector, prevent too large a rotation towards the base of the tilting sector outside the casting zone. Two comments should be made regarding the operation of these tilting elements.

First, the housing within which the tilting sector turns is toroidal, as is the sector itself. Now, it is theoretically not possible to turn a solid torus element within a hollow torus element of the same diameter. In this particular case this is perfectly possible provided that the tilting sector is not made from a single piece having the whole length of the shutter (some twenty centimeters for example) but is made in the form of a stack of elementary sectors 4 to 5 cm high and each one if necessary having its own water inlet and outlet pipes. Under these conditions, and when it is recalled that the radius of the torus is large (50 to 300 meters), the toroidal surfaces are in actual fact almost cylindrical and the sufficient play between the elements in order to ensure their tilting is, if one where to calculate it, of the order of 1/100 mm.

Second, the section made by the plane passing through the liquid metal feed point 71 (section shown in dotted lines) is only approximate. In fact, at this point the shutters are not parallel and they only become so to the right of the plane AB in FIG. 11.

The lower face of the upper tilting sector and the upper face of the lower tilting sector which have been shown to be in contact according to EF in fact form a small varying dihedral angle between the feed point and the outlet point; they are therefore in contact over their whole face only at one point, and elsewhere they rest against one another along one of their edges. In the actual construction of the machines it is clearly important to ensure a better impermeability to the liquid metal than that these two faces be in perfect contact as the liquid metal feed point 71.

FIG. 19 illustrates the solution to this problem. The left hand part of the figure shows a tilting element in a transverse plane with respect to the cast product in various positions from the casting front.

There are six successive positions, from top to bottom; at the level of the casting front, 30 cm further on, 60 cm further on, 90 cm further on, 120 cm further on, and 160 cm further on, the final position.

This figure shows the progressive tilting of the sector and the reduction in thickness of the product, which falls from 80 mm for example to 5 mm.

The right hand part of the figure shows the elements in the same successive positions as in the left hand part, but this time from the right, that is to say through a section from inside the casting space.

From the sketch on the top, corresponding to the first position, it can clearly be seen that on account of a biasing machining of the contact faces of the upper and lower elements, there is total superpositioning of the two faces on one another. Thirty centimeters further on the angle between the two elements is less and a "corner" appears between the two faces which now only touch at their right-hand edge, the play on the left increasing progressively from; 7/10 mm to 30 cm, 15/10 mm to 60 cm, 20/10 mm to 120 cm, 30/10 mm to 120 cm, and 45/10 mm to 160 cm.

This biasing machining of the lower face with respect to the direction perpendicular to the principal faces of the tilting element is thus important in maintaining perfect contact, face to face, at the moment when the metal is liquid, the corner opening only after a crust of metal has already solidified.

FIG. 16 shows a section of a system consisting of two fixed sectors of large diameter and four tilting sectors of small size intended for the casting of slabs; FIG. 18 shows a system consisting only of four tilting sectors without any fixed sector, and intended for the casting of blanks of elliptical cross-section.

In the case of FIG. 17 the ratio of the cross-section initially presented to the liquid metal to the final cross-section may for example be 1.15 to 1.20; in the case of FIG. 18 this ratio may be of the order of 1.1.

The fixed sectors and the tilting sectors are cooled by a circulation of water coming from the shutters. Now, since these shutters move and are independent they need only be cooled in their working zone and the water can circulate in the pipes provided for this purpose only in this zone. On the other hand, the lateral drive devices for the shutters also result in the water feed device being made in such a way that the shutters are automatically connected and disconnected before and after the casting zone of the metal. The solution to these problems is for example obtained in the following manner.

An annular water chamber is situated at each lateral end of each rolling pathway, upper and lower. In FIG. 13 a cross-section 85*b* of the water chamber of one of the sides of the lower rolling pathway, and one of the cross-sections 85*a* of the water chamber of the upper rolling pathway, can clearly be seen.

The water chambers shown in FIG. 13 are, as indicated by the arrows showing the direction of the water circulation, the feed chambers for the shutters, upstream side. The chambers situated on the other edge of the rolling pathways are the water removal chambers for the shutters, downstream side.

FIGS. 20 and 21 will enable the operation of these chambers to be more easily understood.

FIG. 20 shows a transverse section of the lower water zone in the casting zone of the metal, that is to say in the zone where the water chamber is connected to the shutters which it supplies with water.

FIG. 21 is a longitudinal section of this same water chamber in the zone near the liquid metal feed at the point where the water chamber is connected to the shutters.

A metal strip 86 reinforced at the edges by cylindrical keeper rings 87 slides in the pathways 88 and thus seals the external surface of the annular water chamber 85*a* or 85*b*. Impermeability is ensured by a fixed elastic joint 89 pressing on the lateral reinforcement keeper rings of the strip. Under these conditions the clamping of the strip to the joint is proportional to the water pressure. Consequently, on the removal side where there is no pressure it will be necessary to ensure that the keeper ring 87 presses on the pathway 88 by means of an elastic joint 89 which exerts a sufficient pressure to ensure impermeability. This metal strip 86 should being the water chamber into communication with the shutters which move along the rolling pathway; the strip should therefore be driven at the same velocity as the shutters and carry so-called water valve boxes enabling the cooling circuits of the shutters to be connected to the water chamber.

The metal strip thus on the one hand carries stay members 90, and on the other water valve boxes at regular intervals and at a frequency of one water valve box 91 per shutter.

These stay members ensure that the strip has a good transverse rigidity. The water valve boxes and the stay members carry lugs 92 which enable the strip to be driven at the velocity of the shutters by means of pawls 93 integral with the shutters. These pawls press against the lugs 92 and cause the strip to move forward and ensure a correct presentation of the water boxes 91 in front of the corresponding orifices of the shutters.

The water valve box 91 is in fact a coupling comprising a pipe element 94, an admission valve 95, and an inflatable joint 96 provided with its control valve 97.

This system operates as follows. Outside the casting zone, for example for the box shown in the right part of FIG. 21, the two admission valves 95 and control valves 97 for the joints are closed and kept in their seating by a spring. When the orifice of the pipe 94 arrives opposite the orifice of the pipe for the shutter 98 (water valve box in the left of FIG. 21), a first cam 99 (FIG. 20) opens the control valve 97 for the inflatable joint 96. The pressure of the water then forces this joint against the circular bearing surface around the pipe 98, and almost immediately afterwards the cam 100 (FIGS. 20 and 21) opens the admission valve 95, thereby bringing the water circuit of the shutters into communication with the water chamber.

The drive mechanism of the lower shutters may be a mechanism such as is shown in FIGS. 11, 12, 14 and 15. The pinions 67 drive the lower shutters via gearing means 75 located on the sides of these lower shutters. The pinions 67 may be conical (FIGS. 11 and 15) with their axes making a small angle with the plane of symmetry of the machine, but they may also be cylindrical (FIGS. 12 and 14) and are then mounted on the same drive shaft 76, which shaft passes through the fixed bearing segment **65*a* in the cylindrical bearing of oblong cross-section 101. The pinions 67** engage with the shutters to a marked degree after the feed of liquid metal. However, the shutter or shutters placed above this point of engagement of the pinions may be kept joined without too much effort, the cast metal still being to a great extent liquid in this zone.

The upper part of the casting machine like the lower part is provided with rapid return systems for the shutters; in fact, there is no need at all to have a series of connected or joined shutters outside the casting zone. A rapid return system for the shutters from the outlet of the machine up to the inlet means that only a few additional shutters with respect to the number of shutters in use in the casting zone will be required.

At the outlet of the machine the upper shutters **66*a* (FIGS. 11 and 12) move apart progressively, resting on the disengagement grooves 102; they next pass round the upper rolling pathway 65*a* while rolling on the bearings and being driven by rapid return belts 68*a*. They are then reintroduced "upstream" on slide grooves 103** and bear against the already engaged, preceding upper shutters as a result of the force due to gravity.

A similar mechanism cannot be used much for the return of the lower shutters. In fact, the corresponding belts should not only drive the shutters but also support them, and their weight no longer urges them against the rolling pathways as in the case of the upper shutters.

These shutters are fairly heavy articles (several hundreds of kg), which presents problems in making the belts. A mechanism such as is shown in FIG. 11 may for example be provided. The shutters are provided with rollers 104 engaging at the outlet with ramps 105 which deposit them on rapid return rails **68*b*** in the form of vertical sectors several meters in diameter, for example 4 meters in diameter.

The shutters roll along these rails under their own weight and in about two seconds rise to a position which is approximately symmetrical with respect to the starting position. When their velocity becomes practically zero they are then taken (FIG. 11) by lateral drums 106 provided with pawls 107 which deposit them on the rolling carpet 108, or they are raised (FIG. 12) by an elevator carpet 109 to a tilting device 110 which, after tilting, deposits the shutter on the rolling carpets 108. The rolling carpets 108 urge the shutter against the preceding shutter and bring it into engagement with the sheet of bearings.

The reason why the lower shutters should be larger than the upper shutters can be understood. There must be a sufficient time interval between the shutters which drop to the end of the ramps 105, otherwise there will be collisions at this point, and hence the necessity of making the shutters sufficiently large so that a shutter has time to disengage from the starting position before the following one begins to fall.

The clamping system for clamping the two rolling pathways to one another comprises a clamping jack, reference numeral 69 in FIGS. 11 and 12, which enables the support for the upper rolling pathway to be brought closer to the fixed frame of the machine. When this clamping is effected the two rolling pathways pivot around a virtual axis 71 which is situated in the center of the casting front. This connection around the axis 71 is produced by two sheets 70 placed in the plane of the casting front and bolted to bosses **111*a* and 111*b* on both sides and integral with each rolling pathway. These sheets bend slightly when the two rolling pathways are brought together by means of the jack 69**.

The liquid metal feed system is shown diagrammatically in FIG. 22. Its cross-section is adjusted to that presented to the metal by the cooling elements, leaving a play of a few tenths of a millimeter. The gap between the cylindrical bearing segments is kept constant to the right of the casting device, and the cross-section of the latter may therefore be made with a very high degree of accuracy without there being any danger of friction between this device and the cooling elements. It may therefore consist of an external casing 112 of metal cooled by means of an internal water circulation 113. This casing is provided in its center with orifices in which are embedded the refractory pipes 114 carrying the metal.

The metal may thus be introduced under a high hydrostatic pressure. The skin of solidified metal in contact with the moving ingot mold entrains the skin which has begun to solidify in contact with the metal casing support for the pipe or pipes carrying the metal.

In the case of shaped sections the single pipe is situated in the center of the casing. In the case of thin strips, the pipes are distributed regularly at a frequency of one 2 cm diameter pipe every 8 to 10 cms.

The following applications of processes and machines of this type for the casting of various products may be mentioned as non-limiting examples.

It is first of all possible to cast thin strips 4 to 5 mm thick for example, and in widths which may be as much as 1.50 to 2 meters. In this case the initial casting cross-section has the shape shown by the dotted lines in FIG. 16, namely a very elongated curvilinear hexagon whose shorter sides are inclined at about 60° to the horizontal.

A second application example is the casting of blanks intended for the manufacture of wire rods. In this case the shape of the product may be an ellipse such as shown in FIG. 18, with an eccentricity of about 3/5 and an initial cross-section of about 5 $cm^2$, reduced to 46 $cm^2$ after hot working. The shape of the product may also be that of a curvilinear cross which can be inscribed in a square, such as shown in FIG. 17.

Cruciform shaped sections of this type but of larger cross-section, for example of cross-section which can be inscribed in a 30 cm × 30 cm square, may also be obtained by means of this process. One starts for example with a cast cross-section of 500 $cm^2$ to end up with a final cross-section of the order of 400 $cm^2$. This cruciform cross-section also has the advantages of high $$\frac{\text{cooling surface}}{\text{weight of cast metal}}$$

ratio and decrease in the distance between the neutral axis and the surface of the cast product.

The table hereinafter gives some rough casting parameters of the machine in each of the preceding cases:

| Product | Diameter of the rolling pathways | Length of the ingot mold | Initial cross-section | Clamping force | Casting velocity | Output in tonnes/hr. |
|---|---|---|---|---|---|---|
| Strip 5 mm thick | 60 m | 1 m 50 | 1 m 45 × 8 cm | 200 tonnes to 1000 tonnes | 35 m/min | 30 t/hr |
| Wire rod | 300 m | 1 m 70 | 40 $cm^2$ | 20 t to 50 t | 12 m/min | 8 t/hr |
| Cruciform bar | 300 m | 3 m | 250 $cm^2$ | 20 t to 50 t | 4 m/min | 16 t/hr |

Other applications may also be mentioned in the field of metallurgy.

A first application consists of manufacturing plated metal sheet. If a strip of plating metal is held on the surfaces of lower shutters, higher shutters, or both shutters simultaneously, metal casting occurs on these strips and its solidification under pressure insures a very good metallurgical continuity between the base metal and the plating layer or layers.

The plating of the lower face does not present any difficulties for the introduction of the strip. In the case of the upper strip it is necessary to free the space situated above the metal supply device. The proposed solution consists of using a feed channel closed in its upper part in the zone situated above the lower shutter and to supply this closed channel with one or more vertical pipes of sufficient diameter, the said pipes being displaced to the side. This arrangement is possible on account of the fact that it is normal to feed the machine under a high hydrostatic pressure of metal.

The applications of this technique are obviously of interest in the plating of light alloy products with plating layers of a light alloy or of other metals such as copper or steel.

A second application concerns the manufacture of sheets of varying thickness. When the casting velocity decreases, the length of the completely solidified zone where the welding takes place increases. If the clamping force exerted by the jack remains constant the thickness of the product then tends to increase.

It should also be noted at this point that these possible variations in thickness do not influence the initial cross-section presented to the liquid metal since the gap existing between the fixed sectors remains constant to the right of the casting front.

These variations in thickness no longer have any influence on the quality of the drive of the upper shutters by the lower shutters since the gear teeth effecting the displacement of the one by the other come into contact at the height of the casting front. The contact line between these teeth is only slightly different in proportion to the advance, and the longitudinal displacement which may result therefrom is of the order of 1/1000 mm.

It is thus possible to increase progressively the thickness of the product by coupling this thickness to the displacement of the shutters, or also to the casting velocity at this same displacement. It should be noted however that the result of an increase in thickness is to reduce slightly the distance between the casting front and the line of minimum thickness.

Finally, a last application in the field of metallurgy concerns the manufacture of products comprising insertions of strips, fibers tubes, bars or cables, in particular sheathed cables with an aluminium sheath, or steel bars or cables coated with a thick layer of aluminum.

In this case it is sufficient to piece the support for the liquid metal feed nozzles with orifices of suitable cross-section to allow the passage of filaments, wires, strips, tubes, bars, etc. and in general of various materials which can serve to sheath or armour longitudinally the sheet or shaped product obtained.

FIGS. 23 and 24 show two illustrations of this application.

FIG. 23 shows two successive transverse cross-sections in the casting of products containing an insert.

The left part of FIG. 23 is a section at the level of the liquid metal feed. The reference numeral 114 and the corresponding symmetrically located integer in the upper part of the section is the cross-section of the two refractory feed nozzles. Reference numeral 115 represents the insert, in this case a cable, bar or tube of steel, copper or aluminium. Reference numeral 113 denotes the projection of the cooling tubes of the feed spout, and reference numerals 78 and 79 denote the fixed and tilting cooling sectors. In the righthand section made at the level of the product outlet, the fixed sectors 78 have come together, while the sectors 79 have tilted, giving the product its symmetrical cruciform shape, surrounding the insert 115. FIG. 24 shows how a covered cable may be obtained. The cable has the reference numeral 115, the circumferences shown in dotted lines symbolizing the successive layers of the strands. The left-hand section is taken at the level of the liquid metal feed, the two feed nozzles being denoted by the reference numerals 114. In this case the welding of the metal leads to the formation of two small side wings between each of the upper and lower tilting sectors.

It has already been pointed out that the casting between fixed cylindrical bearing segments may be applied to all metals and alloys. It is however useful to specify certain specific provisions of the process which make it particularly suitable for the casting of very strongly oxidizable metals at high temperatures (solid or liquid), or metals which are difficult to maintain in the liquid state in a refractory crucible without there being reduction of the crucible material by the metal (for example titanium or zirconium) or also metals which are highly oxidizable and present great difficulties in casting products without any internal faults (for example beryllium).

The method which is generally of interest to employ is that of direct melting of a consumable electrode in a cooled crucible in which immediate solidification takes place.

The fact that in the casting between fixed cylindrical bearing segments the cross-section presented by the ingot mold is very strictly adjusted to that of the feed device without any appreciable play and without any possible superfluous and redundant clamping is especially beneficial in producing an electrode carrier of an insulating and refactory material, and in establishing a neutral, protective atmosphere in the casting shaft. This beneficial feature is also maintained even if the gap between the bearing cylinders is varied and the thickness of the cast product is also varied. The device employed may be described thus. The feed nozzle made of a refractory and insulating material 116, FIG. 25, comprises one or more cylindrical orifices allowing the passage of one or more electrodes 117. The bars 117 of powder or compressed metal granules are pressed against one another by the drive rollers 118. The orifices of the nozzle 116 are provided with electric current contact leads 119. For their part, the shutters **78*a* and 78*b* are provided with current pick-up leaves which slide on conductors integral with the fixed bearing segments and are insulated with respect thereto. Protection against oxidation in the casting shaft from the electric arc 120 is ensured by means of an argon or helium atmosphere introduced by pipes 121 arranged in the nozzle 116.**

This technique of feeding the machine by melting consumable electrodes may also be extended to the fusion of compressed powders or granules of other metals or mixtures of metals and non-metallic products.

The use of this technique is of particular interest in the case of highly oxidizable metals, since in enabling already highly complicated semifinished products to be obtained directly from the basic granular material it avoids the intermediate transformation and heating operations which are absolutely necessary at the present time, as well as the associated and expensive procedures which they involve, and the ricks of contamination and deterioration of the metallurgical properties which may result.

I claim:

1. A process for the continuous casting of products of metal alloys such as strips, sheets, bars, blanks for wire rods, ingots and special products, comprising the casting of liquid metal between two surfaces, at least one of which is convex, applying a high pressure to the metal during solidification via these surfaces, the final thickness of the product may be appreciably reduced with respect to the initial thickness presented to the liquid metal, and keeping the cast product on the sides during its reduction in thickness by means of cooled tilting or retracting lateral sectors, the casting of liquid metal between two surfaces involving feeding the liquid metal near the upper generatrix of a cooled rotating casting drum, applying a series of shutters, which are also cooled and are almost joined, around the effective part of the drum and turning the series of shutters at the same rate as the drum, exerting a high pressure on the metal throughout the solidification via the shutters, the pressure of the shutters on the metal being exerted via one or more endless chains or cables acting on the side of the shutters opposite the cast metal and forcibly urging the shutters against the cast metal, and turning at a velocity synchronized with that of the drum, releasing the shutters from the action of the cables or chains, in the vicinity of the outlet for the cast product, the said shutters falling under their own weight, guiding the shutters by a rolling pathway, and moving and raising the shutters by belts to the vicinity of the liquid metal feed point where drive rollers bring them into a quasi-joined arrangement, spacing members being disposed on the said shutters, cooling of the shutters by circulating cooling fluid from the casting drum, and effecting an alignment of connection openings of the cooling fluid circuits of the drum and the shutters around the effective part of the drum by the spacing members of the shutters.

2. A process for manufacturing thin products according to claim 1, wherein the lateral sectors of the casting drum corresponding to the thickness of the product are retracted during casting in order to allow direct contact between the shutters and the cast product.

3. A process for manufacturing ingots according to claim 2, wherein the casting drum has a width equal to the length of the ingot, and forming easily breakable, thin metal bridges between adjacent ingots by the shape of the shutters.

4. A process for manufacturing ribbed sheets, plating sheets, and engraved strips according to the process of claim 2, characterized in that the parts of the sheet or strips which are in relief are engraved hollow on the drum.

5. A process for manufacturing plated sheets according to claim 2, including holding a plating strip on the casting drum at the start upstream of the liquid metal feed and cooling the strip on its external face by the casting drum.

6. A process for manufacturing castings according to claim 2, including the provision of engravings in the casting drum to constitute the lower half mold and engravings in the shutters to constitute the upper half mold of the article.

7. A process for manufacturing metal strips with inserts, according to claim 5, wherein shaped metal sections are continuously inserted into grooves made in the rim of the casting drum upstream of the liquid metal feed.

8. A process for the continuous casting of products of metal alloys such as strips, sheets, bars, blanks for wire rods, ingots and special products, comprising the casting of liquid metal between two surfaces, at least one of which is convex, applying a high pressure to the metal during solidification via these surfaces, the final thickness of the product may be appreciably reduced with respect to the initial thickness presented to the liquid metal, and keeping the cast product on the sides during its reduction in thickness by means of cooled tilting or retracting lateral sectors, the casting of liquid metal between two surfaces involving feeding the liquid metal near the upper generatrix of a cooled rotating casting drum, applying a series of shutters, which are almost joined, around the effective part of the drum and turning the series of shutters at the same rate as the drum, exerting a high pressure on the metal throughout the solidification via the shutters, cooling of the shutters by circulating cooling fluid from the casting drum, and effecting an alignment of connection openings of the cooling fluid circuits of the drum and the shutters by uniform spacing members spacing the shutters around the effective part of the drum.

9. Apparatus for the continuous casting of metal products such as strips, sheets, bars, blanks for wire rods, ingots, and the like; said apparatus comprising two moving surfaces, at least one of which is convex, means for pouring liquid metal on the convex surface, means for cooling the convex surface, the second surface being oriented relative to the convex surface for the application of high pressure to the liquid metal fed on the convex surface, said second surface comprising a series of cooled shutters which extend about the effective part of the convex surface, and means for moving the series of shutters at the same rate as the convex surface, said moving surfaces comprising two series of lower and upper shutters each carrying fixed and tilting lateral cooled sectors, lower and upper rolling pathways, at least one of which has a cylindrical convex shape of large diameter in the casting zone, and on which these shutters roll, the axes of the pathways being in the same approximate vertical plane, a water feed system to each series of shutters operative only when they are in the casting zone, a mechanism for driving the lower and upper shutters on the rolling pathways, a rapid return system for the upper and lower shutters, and a clamping system for the upper and lower rolling pathways, the water feed system to each of the series of upper and lower shutters including a hydrant integral with a continuous metal strip driven by the shutters, said metal strip forming the moving wall of an annular water chamber adopting the shape of the rolling pathway and situated at one end of the shutters, a similar device situated at the opposite end of the shutters ensuring the removal of the water.

10. A process for the continuous casting of products of metal alloys such as strips, sheets, bars, ingots and special products, comprising casting liquid metal between the external surface of a cooled rotating drum and the external surfaces of a series of shutters, also cooled and almost joined around the effective part of the drum and turning at the same rate as the drum, and within retracting lateral sectors, exerting a high pressure on the cast metal, via one or more endless chains or cables acting on the shutters and urging the shutters against the cast metal, raising the shutters by belts from the vicinity of the outlet of the cast product to the vicinity of the liquid metal feed point, cooling the shutters by circulating cooling fluid from the rotating drum, and aligning connection openings of the cooling fluid circuits of the drum and the shutters by the uniform spacing of the shutters around the effective part of the drum.

11. A process for manufacturing thin products according to claim 10, wherein the lateral sectors correspond to the thickness of the product and are retracted during casting in order to allow direct contact between the shutters and the cast product.

12. A process for manufacturing ingots according to claim 11, wherein the drum has a width equal to the length of the ingot, and forming easily breakable, thin metal bridges between adjacent ingots by the shape of the shutters.

13. A process for manufacturing ribbed sheets. plating sheets, and engraved strips according to the process of claim 11, characterized in that the parts of the sheet or strips which are in relief are engraved hollow on the drum.

14. A process for manufacturing plated sheets according to claim 11, including holding a plating strip on the drum at the start upstream of the liquid metal feed and cooling the strip on its external face by the drum.

15. A process for manufacturing metal strips with inserts, according to claim 11, wherein shaped metal sections are continuously inserted into grooves made in the rim of the drum upstream of the liquid metal feed.

16. A process for manufacturing castings according to claim 10, including the provision of engravings in the drum to constitute the lower half mold and engravings in the shutters to constitute the upper half mold of the article.

17. Apparatus for the continuous casting of metal alloys and in particular of aluminum alloys, comprising a moving casting mold including a casting drum having an internal cooling fluid circuit and being cooled by internal circulation of fluid therethrough, said drum constituting one of the walls of the moving casting mold; an assembly of quasi-joined shutters surrounding a part of the circumference of the drum, said shutters constituting the opposite wall of the moving casting mold, having a cooling fluid circuit therein, and being cooled by circulation of fluid from the casting drum; said cooling fluid circuits of the drum and shutter having connection openings therein; means for aligning and connecting the connection openings of the cooling fluid circuits of the drum and the shutters for the circulation of cooling fluid therebetween; retractable lateral sectors, constituting the small sides of the moving casting mold; a system of cables or chains maintaining contact under pressure with the shutters about said part of the circumference of the drum; and a raising mechanism for raising the shutters after the exit of the cast product.

18. Apparatus for the continuous casting of metal products as strips, sheets, bars, blanks for wire rods, ingots, and the like, said apparatus comprising: a moving casting mold formed by two opposed moving convex surfaces of very large diameter, said convex surfaces consisting of two series of lower and upper cooled shutters each carrying fixed and tilting lateral cooled sectors, opposed lower and upper rolling pathways having an inlet and an outlet, said two series of shutters rolling on lower and upper pathways, the axes of the pathways being in the same approximate vertical plane; means for pouring liquid metal between said convex surfaces; a mechanism for driving the lower and upper shutters on the rolling pathways; a rapid return system for the upper and lower shutters between the outlet and the inlet of the rolling pathways; a clamping system clamping the upper and lower rolling pathways to each other and maintaining the distance thereabout at the outlet less than at the inlet; and a water feed system for cooling the shutters of each series, said water feed system being operative only when they are in the casting zone.

19. Casting apparatus according to claim 18, characterized in that the shutters roll on the rolling pathways via sheets of bearings or rollers moving in longitudinal grooves made in the rolling pathways and maintained in flexible supports.

20. Casting apparatus according to claim 18, characterized in that the water feed system to each of the series of upper and lower shutters includes a hydrant integral with a continuous metal strip driven by the shutters, said metal strip forming the moving wall of an annular water chamber adopting the shape of the rolling pathway and situated at one end of the shutters, a similar device situated at the opposite end of the shutters enduring the removal of the water.

21. Casting apparatus according to claim 18, characterized in that the rapid return system for the upper shutters consists of a drive belt, and that for the lower shutters is a system of rails and an elevator.

22. Casting apparatus according to claim 18, characterized in that the system for clamping the upper rolling pathway to the lower rolling pathway comprises a jack which brings together the rolling pathways on the metal outlet side and sheets, having a thickness and width calculated to support without any appreciable deformation the imposed tractive and bending forces, which are bolted to the rolling pathways on the metal inlet side, thereby maintaining a distance between these two pathways which is virtually constant at this point.

23. Casting apparatus according to claim 10, including a liquid metal feed nozzle having a cross-section which is exactly adjusted to that presented by the moving shutters at the outlet orifice of the nozzle.

24. Casting apparatus according to claim 23, characterized in that the feed nozzle is made of a refractory and insulating material which allows an electric arc to be established and ensures the fusion of an electrode and the supply of liquid metal to the casting shaft.

25. Casting apparatus according to claim 24, characterized in that the feed nozzle accommodates consumable electrodes and is provided with an inlet pipe for a neutral protecting gas to establish a protective atmosphere against oxidation in the zone of the casting shaft.

* * * * *